US010465512B2

(12) United States Patent
Kenno et al.

(10) Patent No.: US 10,465,512 B2
(45) Date of Patent: Nov. 5, 2019

(54) ROTATABLE CUTTING TOOL

(71) Applicant: Kennametal Inc., Latrobe, PA (US)

(72) Inventors: Brandon J. Kenno, Windber, PA (US); Nicholas J. Paros, Johnstown, PA (US); Chad Swope, Bedford, PA (US)

(73) Assignee: KENNAMETAL INC., Latrobe, PA (US)

( * ) Notice: Subject to any disclaimer, the term of this patent is extended or adjusted under 35 U.S.C. 154(b) by 0 days.

(21) Appl. No.: 15/445,041

(22) Filed: Feb. 28, 2017

(65) Prior Publication Data

US 2018/0245467 A1 Aug. 30, 2018

(51) Int. Cl.
*E21C 35/18* (2006.01)
*E21C 35/183* (2006.01)

(52) U.S. Cl.
CPC .... *E21C 35/183* (2013.01); *E21C 2035/1803* (2013.01)

(58) Field of Classification Search
CPC ..... E21C 35/18; E21C 35/183; E21C 35/1803
See application file for complete search history.

(56) References Cited

U.S. PATENT DOCUMENTS 4,944,559 A 7/1990 Sionnet
5,131,725 A 7/1992 Rowlett
5,702,160 A 12/1997 Levankovskii
6,375,272 B1 4/2002 Ojanen
6,733,087 B2 * 5/2004 Hall ..... E21C 35/183 299/111
7,320,505 B1 * 1/2008 Hall ..... B28D 1/188 299/105
7,959,234 B2 6/2011 Cameron et al.
8,424,974 B2 4/2013 Latham
8,562,079 B2 * 10/2013 Wang ..... E21C 35/183 299/111
8,646,848 B2 * 2/2014 Hall ..... E21C 35/183 299/103
8,960,810 B2 2/2015 Fader
9,039,099 B2 * 5/2015 Sollami ..... E21C 35/183 299/79.1
D742,948 S 11/2015 Kenno et al.
9,238,893 B2 1/2016 Latham
2008/0309149 A1 * 12/2008 Hall ..... A47C 3/00 299/113
2009/0066149 A1 3/2009 Hall
2009/0200855 A1 * 8/2009 Hall ..... E21C 35/183 299/10
2012/0146391 A1 6/2012 Hall et al.
2012/0242136 A1 9/2012 Ojanen
(Continued)

OTHER PUBLICATIONS

May 24, 2018 International Search Report Transmitted.

*Primary Examiner* — Janine M Kreck
(74) *Attorney, Agent, or Firm* — Ian K. Samways

(57) ABSTRACT

A cutting tool rotatable about a central longitudinal axis of the cutting tool and configured for impingement upon a substrate includes an elongate cutting tool body having a head and a shank axially rearward of the head. The head includes a cutting member at an axial forward end thereof, a bolster portion axially rearward of the cutting member and a base portion at an axial rearward end of the head. In addition, the bolster portion includes a convex shape section and a generally cylindrical section contiguous with and axially rearward of the convex shape section.

18 Claims, 28 Drawing Sheets

(56) References Cited

U.S. PATENT DOCUMENTS

| | | | |
|---|---|---|---|
| 2015/0198040 | A1 | 7/2015 | Voitic |
| 2015/0300166 | A1 | 10/2015 | Ries et al. |
| 2016/0024918 | A1 | 1/2016 | Hall et al. |

* cited by examiner

ROTATABLE CUTTING TOOL

BACKGROUND OF THE INVENTION

The invention pertains generally to a cutting tool that is useful for the impingement of a substrate or earth strata such as, for example, asphaltic roadway material, coal deposits, mineral formations and the like. More specifically, the invention pertains to the aforementioned cutting tool wherein the cutting tool is rotatable about its central longitudinal axis and carries a superhard cutting member at the axially forward end thereof. The superhard cutting member can be made from a superhard material (or includes a portion thereof made from a superhard material). Superhard materials useful in the present invention include, without limitation, materials such as polycrystalline diamond (PCD) or polycrystalline cubic boron nitride (PCBN).

A cutting tool for the described uses typically presents a generally elongate, cylindrical geometry. The cutting tool comprises an elongate cutting tool body, which has an axially forward end and an opposite axially rearward end. A hard cutting member or a superhard cutting member typically affixes to the axial forward end of the cutting tool body. The cutting tool body typically carries an assembly or means by which the cutting tool is rotatably carried by a stationary block or holder on a drum.

Cutting tools can experience extreme wear and failure in a number of ways due to the environment in which they operate and must be frequently replaced. It would thus be highly desirable to provide an improved cutting tool that experiences an increase in useful tool life as compared to heretofore known cutting tools.

SUMMARY OF THE INVENTION

In accordance with an aspect of the invention, a cutting tool rotatable about a central longitudinal axis of the cutting tool and configured for impingement upon a substrate includes an elongate cutting tool body having a head and a shank axially rearward of the head. The head includes a cutting member at an axial forward end thereof, a bolster portion axially rearward of the cutting member and a base portion at an axial rearward end of the head. In addition, the bolster portion includes a convex shape section and a generally cylindrical section contiguous with and axially rearward of the convex shape section. In one aspect, the head has an axial length dimension H, the convex shape section has an axial length dimension X and the generally cylindrical section has an axial length dimension Y, the ratio (X+Y)/H being in the range of about 0.5 to about 0.75.

In accordance with another aspect of the invention, a cutting tool rotatable about a central longitudinal axis of the cutting tool and configured for impingement upon a substrate includes an elongate cutting tool body having a head and a shank axially rearward of the head. The head includes: a cutting member at an axial forward end thereof, the cutting member having a substrate and a layer of a superhard material adhered to the substrate; a bolster portion axially rearward of the cutting member, wherein the bolster portion includes a convex shape section and a generally cylindrical section contiguous with and axially rearward of the convex shape section, the bolster further including a socket at an axial forward end thereof, wherein the socket includes a sidewall having a plurality of projections formed thereon and configured for cooperating with the substrate of the cutting member for affixing the cutting member to the cutting tool body; and a base portion at an axial rearward end of the head.

In accordance with an additional aspect of the invention, a cutting tool rotatable about a central longitudinal axis of the cutting tool and configured for impingement upon a substrate includes an elongate cutting tool body having a head and a shank axially rearward of the head. The head includes: a cutting member at an axial forward end thereof, the cutting member having a substrate and a layer of a superhard material adhered to the substrate; a bolster portion axially rearward of the cutting member, wherein the bolster portion includes a convex shape section and a generally cylindrical section contiguous with and axially rearward of the convex shape section, the bolster further including a socket at an axial forward end thereof, wherein the socket includes a sidewall having a plurality of projections formed thereon and configured for cooperating with the substrate of the cutting member for affixing the cutting member to the cutting tool body; and a base portion at an axial rearward end of the head. In one aspect, the head has an axial length dimension H, the convex shape section has an axial length dimension X and the generally cylindrical section has an axial length dimension Y, the ratio (X+Y)/H being in the range of about 0.5 to about 0.75.

These and other aspects of the present invention will be more fully understood following a review of this specification and drawings.

BRIEF DESCRIPTION OF THE DRAWINGS

FIG. 3AA is a sectional view similar to FIG. 3A but showing an alternate bolster, in accordance with an aspect of the invention.

DETAILED DESCRIPTION

Figure 1:
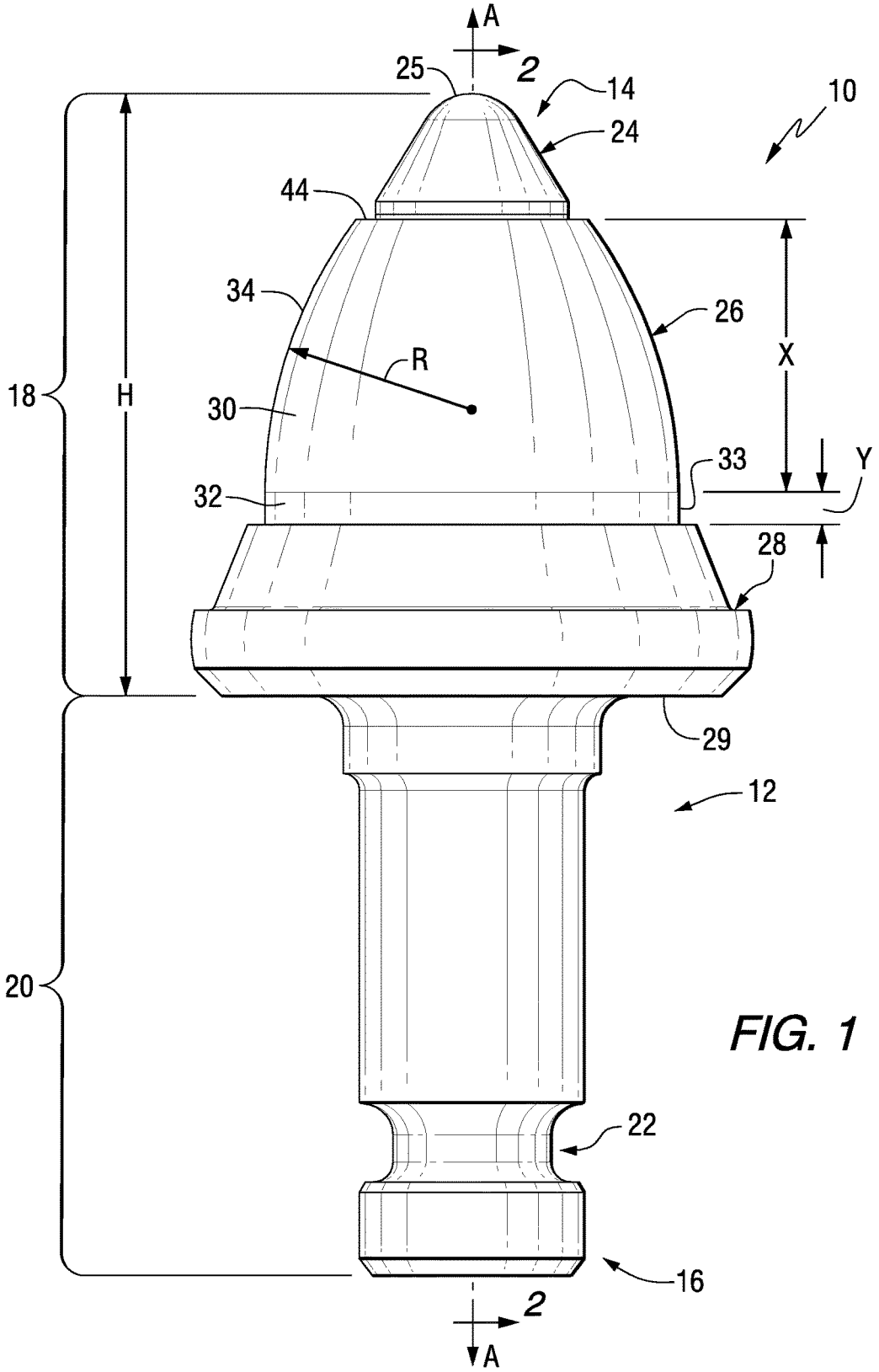
FIG. 1 is a side view of a cutting tool, in accordance with an aspect of the invention.
Figure 2:
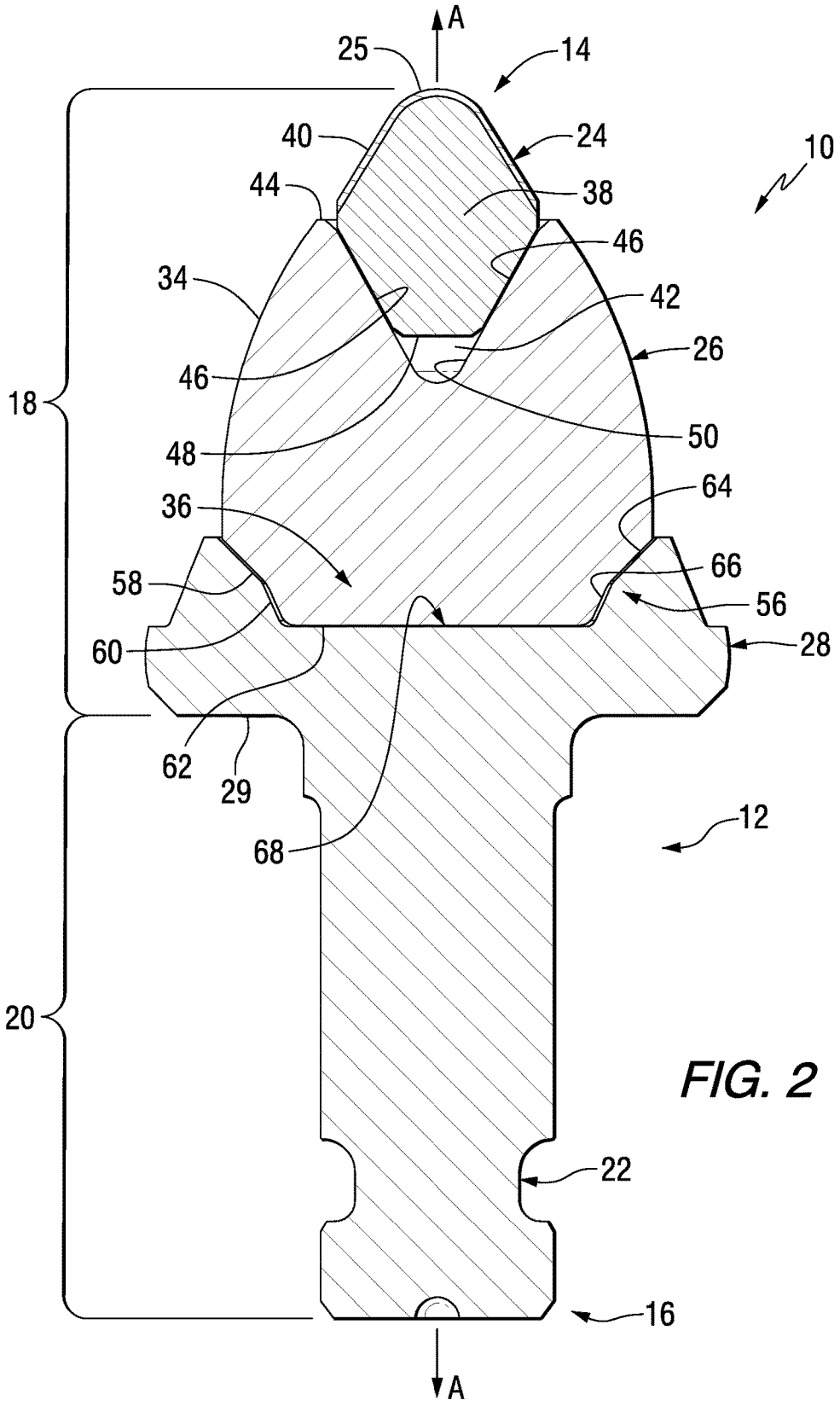
FIG. 2 is a sectional view along line 2-2 of FIG. 1, in accordance with an aspect of the invention.

Referring to the drawings, FIGS. 1-2 illustrate a cutting tool of the invention, generally designated as 10. In one aspect, the invention illustrated herein pertains generally to road planing tools. However, one should appreciate that the invention has application to other kinds of cutting tools useful in other kinds of cutting operations. Exemplary operations include without limitation road planing (or milling), coal mining, concrete cutting, and other kinds of cutting operations wherein a cutting tool with a hard cutting member impinges against a substrate (e.g., earth strata, pavement, asphaltic highway material, concrete, and the like) breaking the substrate into pieces of a variety of sizes including larger-size pieces or chunks and smaller-sized pieces including dust-like particles. In addition, it will be appreciated that the cutting tool 10 of the invention may be manufactured in various sizes and dimensions depending upon the desired application of the tool. In another aspect, as used herein, the term "cutting tool" generally refers to rotatable cutting tools.

Cutting tool 10 has a central longitudinal axis A-A. In one aspect, the cutting tool 10 is rotatable about the axis A-A. In another aspect, cutting tool 10 may be symmetrical about the axis A-A. Cutting tool 10 includes an elongate cutting tool body, generally designated as 12. In one aspect, elongate cutting tool body 12 presents a generally cylindrical geometry and has an axial forward end 14 and an axial rearward end 16.

Elongate cutting tool body 12 includes a head or head portion 18 and a shank or shank portion 20 axially rearward of the head 18. In one aspect, the shank 20 includes an annular groove 22 adjacent the axial rearward end 16 for receiving a retainer ring (not shown), as is generally known. It will be appreciated that the head 18 and the shank 20 may have various sizes, shapes and/or configurations in accordance with aspects of the invention.

In one aspect, the head 18 includes a cutting member 24 at an axial forward end 25 thereof, a bolster portion 26 axially rearward of the cutting member 24 and a base portion 28 at an axial rearward end 29 of the head 18.

Figure 3A:
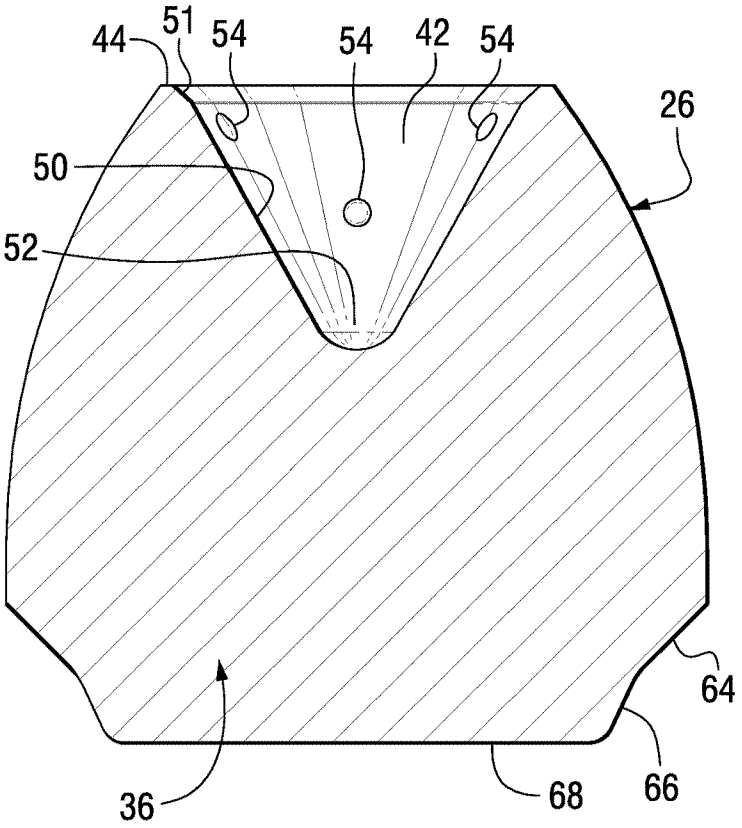
FIG. 3A is a sectional view along line 3A-3A of FIG. 3, in accordance with an aspect of the invention.
Figure 3:
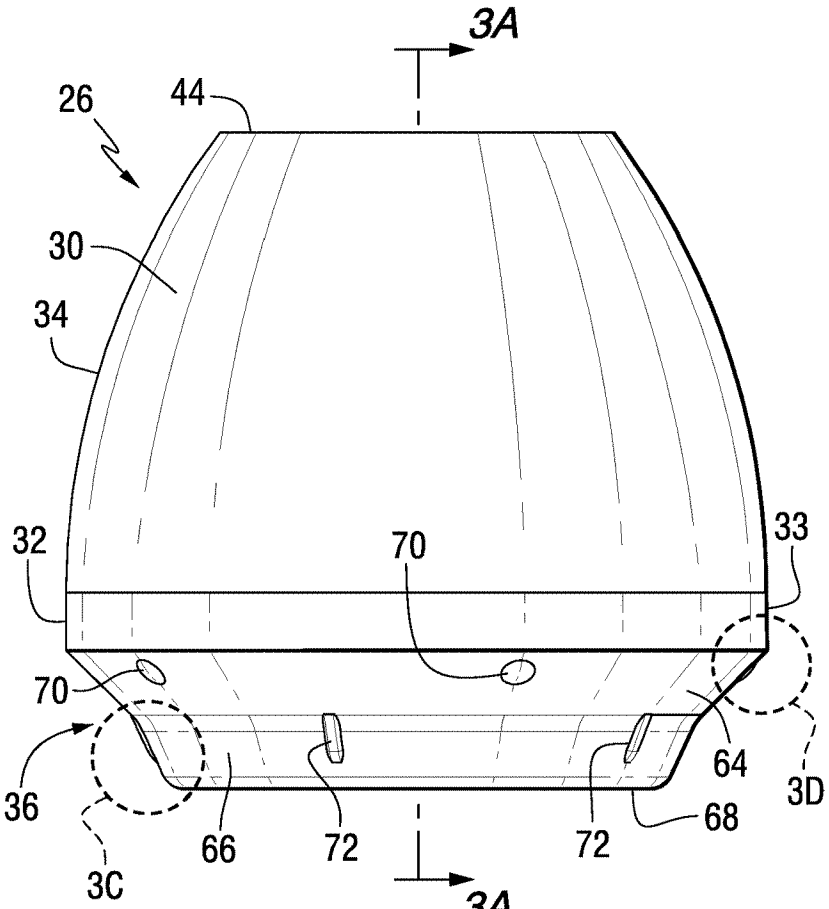
FIG. 3 is a side view of an exemplary bolster of the cutting tool shown in FIG. 1, in accordance with an aspect of the invention.

Referring to, for example, FIGS. 1-3, the bolster portion 26 includes a convex shape section 30 and a generally cylindrical section 32 contiguous with and axially rearward of the convex shape section 30. In one aspect, the convex shape section 30 is generally convex with an outer surface 34 thereof being generally arcuate and curving outwardly from the central longitudinal axis A-A of the cutting tool 10. In addition, the generally cylindrical section 32 is generally cylindrical in shape about the axis A-A and includes an outer surface 33 that is generally linear and thus generally parallel to the axis A-A. In another aspect, the bolster portion 26 of the head 18 includes, at least in part, a cemented (cobalt) tungsten carbide material.

As illustrated in FIG. 1, the head 18 has an overall axial length dimension H, the convex shape section 30 of the bolster portion 26 has an axial length dimension X and the generally cylindrical section 32 of the bolster portion 26 has an axial length dimension Y.

In one aspect, the axial length dimension X can be in the range of about 0.5 inches to about 1.0 inches. In another aspect, the axial length dimension X can be in the range of about 0.6 inches to about 0.9 inches. In another aspect, the axial length dimension X can be in the range of about 0.7 inches to about 0.8 inches.

In one aspect, the axial length dimension Y can be in the range of about 0.05 inches to about 0.55 inches. In another aspect, the axial length dimension Y can be in the range of about 0.1 inches to about 0.3 inches.

In one aspect, the axial length dimension H can be in the range of about 1.7 inches to about 1.8 inches. In another aspect, the axial length dimension H can be in the range of about 1.72 inches to about 1.78 inches.

In one aspect of the invention, the ratio (X+Y)/H is in the range of about 0.5 to about 0.75. In another aspect of the invention, the ratio (X+Y)/H is in the range of about 0.5 to about 0.6.

In one aspect of the invention, the axial length dimension X can be in the range of about 0.5 inches to about 1.0 inches, the axial length dimension Y can be in the range of about 0.05 inches to about 0.55 inches, the axial length dimension H can be in the range of about 1.7 inches to about 1.8 inches and the ratio (X+Y)/H is in the range of about 0.5 to about 0.75.

Advantageously, a bolster portion 26 having the dimensions and/or ratios set forth herein along with being formed, at least in part, of a cemented (cobalt) tungsten carbide material allows for the bolster portion 26 to retain its shape and integrity for a longer period of time during use and aids in reducing wear to other components of the cutting tool 10 such as, for example, the shank 20 or block/tool holder (not shown) for receiving the cutting tool 10.

In another aspect of the invention, the convex shape section 30 of the bolster portion 26 can have a radius R (see, for example, FIG. 1). In one aspect, the radius R is in the range of about 1.2 inches to about 1.4 inches. In another aspect, the radius R is in the range of about 1.25 inches to about 1.35 inches. Advantageously, this configuration of having the radius R provides, for example, the necessary structure and support for the cutting member 24. In addition, this configuration advantageously provides, for example, the ability to add mass or size to the bolster portion 26 for improved wear while still maintaining a streamlined design for efficient cutting.

In another aspect of the invention, the ratio Y/X (i.e., the ratio of the axial length dimension of the generally cylindrical section 32 to the axial length dimension of the convex shape section 30) is in the range of about 0.05 to about 1.0. In one aspect, the ratio Y/X is in the range of about 0.1 to about 0.6. In another aspect, the ratio Y/X is in the range of about 0.125 to about 0.3. Advantageously, this configuration regarding the ratio Y/X provides, for example, support and/or protection for the cutting member 24 during cutting and can reduce moment loading on the shank 20 thus reducing wear and extending the life of the cutting tool 10.

Referring particularly to FIG. 2, the cutting member 24 includes a substrate 38 and a layer of a superhard material 40 adhered to the substrate 38. The substrate 38 of the cutting member 24 includes, at least in part, a cemented (cobalt) tungsten carbide material. The layer of superhard material 40 can include, for example, polycrystalline diamond (PCD) or polycrystalline cubic boron nitride (PcBN). The layer of superhard material 40 may have a generally constant thickness and can be applied to the substrate 38 by any one of a number of known techniques wherein the superhard material 40 is bonded to the surface of the substrate 38. In addition, the layer of superhard material 40 is shown as having a particular shape, but it will be appreciated that it may have other shapes, configurations and/or thicknesses as desired or required for particular cutting operations.

In one aspect, the substrate 38 of the cutting member 24 includes sidewalls 46 that generally taper in the axial rearward direction. The substrate 38 also includes a bottom surface 48.

Referring to FIGS. 2, 3, 3A, 3E and 3F, the bolster portion 26 includes a socket 42 at an axial forward end 44 that is configured for receiving and affixing the cutting member 24 to the cutting tool body 12. Generally, the socket 42 includes a sidewall 50 configured for cooperating with and receiving the substrate 38 of the cutting member 24. More particularly, the socket 42 includes sidewalls 50 structured and arranged for receiving the tapered sidewalls 46 of the substrate 38 of the cutting member 24. In one aspect, the sidewalls 50 of the socket 42 generally taper in the axial rearward direction similar to the tapering of the sidewalls 46 of the substrate 38. The socket 42 may include an upper tapered sidewall portion 51 that does not contact the substrate 38 in the example shown, but could if the substrate 38 had a different shape or configuration. In addition, the socket 42 includes a bottom surface 52 that, in one example, may be spaced apart from the bottom surface 48 of the substrate 38.

In another aspect, the cutting member 24 can be affixed to the bolster portion 26 by brazing the sidewalls 46 of the substrate 38 to the sidewalls 50 of the socket 42. Although not required, brazing may also be provided between the bottom surface 48 of the substrate 38 and a bottom surface 52 of the socket 42. In order to enhance the brazing between the sidewalls 46 of the substrate 38 and the sidewalls 50 of the socket 42, a plurality of projections 54 are provided and formed on the sidewall 50 of the socket 42 (see, for example, FIGS. 3A, 3E, 3F and 3G). Generally, the plurality of projections 54 are configured for cooperating with the substrate 38 of the cutting member 24 for affixing the cutting member 24 to the cutting tool body 12. More particularly, the projections 54 provide a raised surface that extends outwardly from the sidewall 50 such that the sidewall 46 of the substrate 38 contacts and rests thereon providing spacing or a gap between sidewalls 46 and 50 so as to allow the brazing to flow more easily and uniformly between the sidewalls 46 and 50. In addition, the projections 54 can provide for accurate positioning, e.g. centering, of the substrate 38 in the socket 42.

In one aspect, the plurality of projections 54 can be symmetrically positioned within the socket 42 about the central longitudinal axis A-A of the cutting tool 10. For example, FIG. 3E illustrates that selected projections 54 can be equally spaced at 120 degrees. In addition, FIGS. 3A, 3E and 3F illustrate that selected projections 54 can be formed more adjacent the axial forward end 44 and other projections 54 can be formed more axially rearward in the socket 42. It will be appreciated that other configurations and arrangements of the projections 54 can be provided in accordance with aspects of the invention.

It will be appreciated that the substrate 38, the cutting member 24 and/or the socket 42 may have various shapes, sizes and configurations in accordance with aspects of the invention. For example, FIG. 3AA illustrates a sectional view similar to FIG. 3A but showing an alternate bolster portion 26*a*, in accordance with an aspect of the invention, with a socket 42*a* having an upper tapered sidewall 51*a*, tapered sidewall 50*a*, a bottom surface 52*a* and including raised projections 54*a*. In one aspect, the socket 42*a* is of generally different dimension, shape and/or configuration than the example shown in FIG. 3A so as to accommodate a cutting member/substrate of different dimension, shape and/or configuration.

Figure 3B:
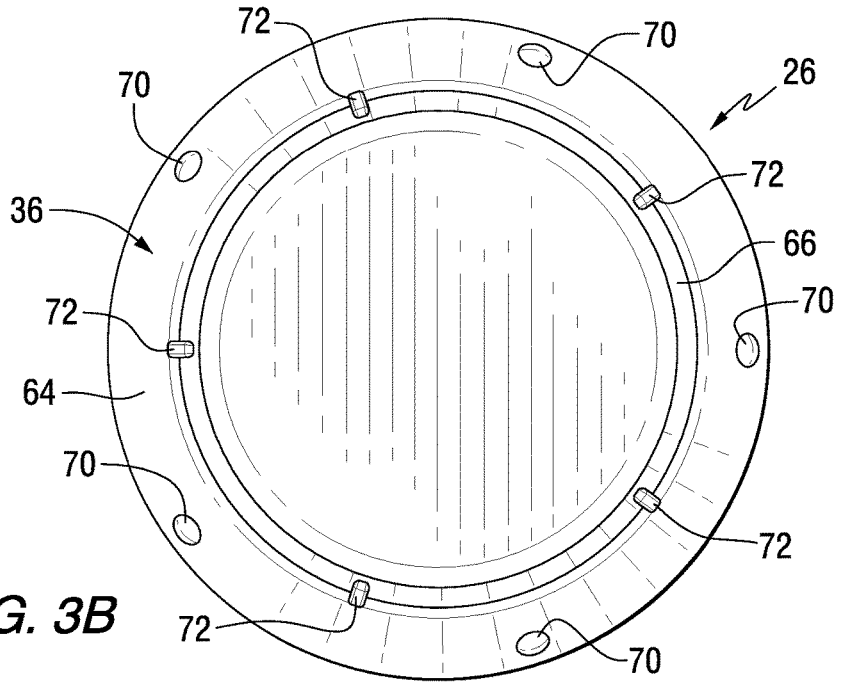
FIG. 3B is a bottom view of FIG. 3, in accordance with an aspect of the invention.
Figure 3E:
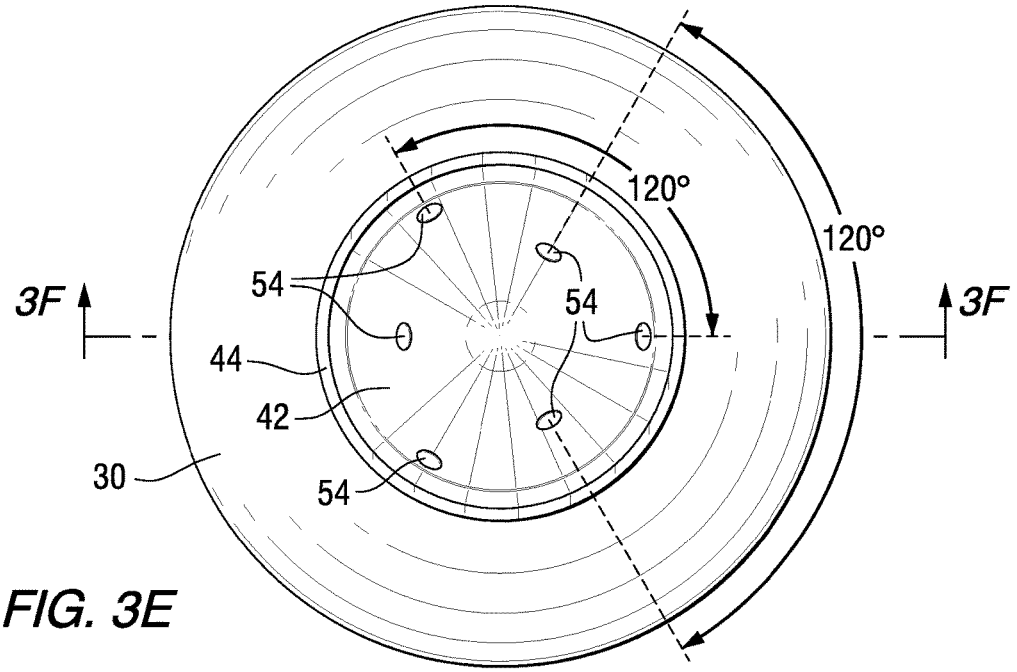
FIG. 3E is a top view of FIG. 3, in accordance with an aspect of the invention.
Figure 3C:
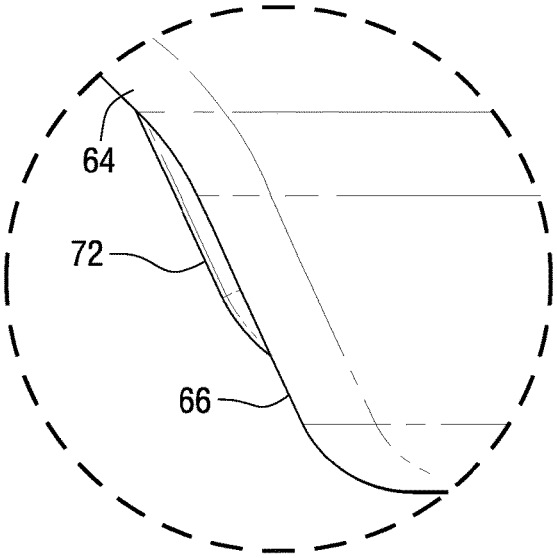
FIG. 3C is an enlarged detail of the area 3C of FIG. 3, in accordance with an aspect of the invention.
Figure 3F:
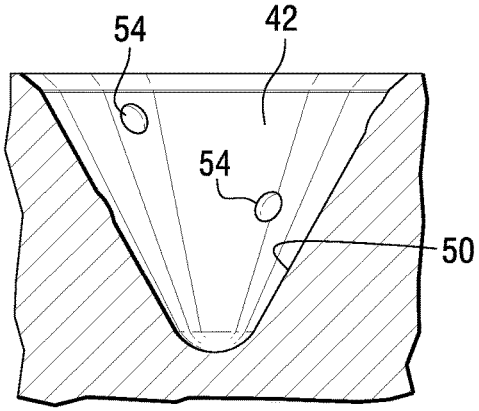
FIG. 3F is a sectional view along line 3F-3F of FIG. 3, in accordance with an aspect of the invention.
Figure 3D:
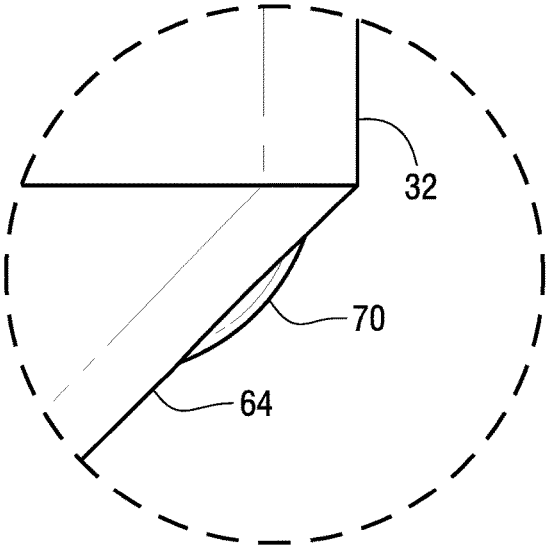
FIG. 3D is an enlarged detail of the area 3D of FIG. 3, in accordance with an aspect of the invention.
Figure 3A:
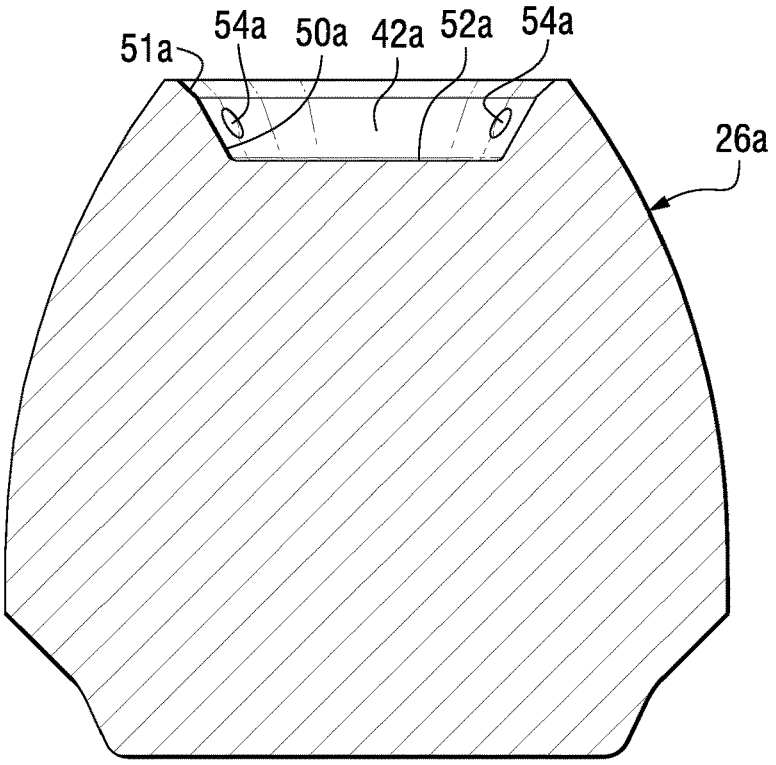
Figure 3G:
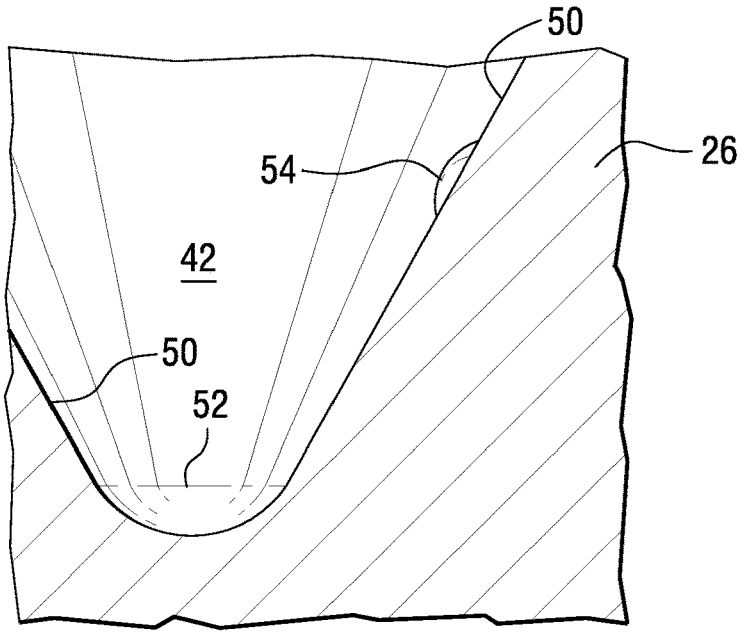
FIG. 3G is an enlarged, partial sectional view similar to FIG. 3A partially rotated about line 3A-3A, in accordance with an aspect of the invention.

Referring generally to FIGS. 2 and 3-3D, in addition to the convex shape section 30 and the generally cylindrical section 32 the bolster portion 26 may include a rearward end, generally designated as 36, that is axially rearward of and contiguous with the generally cylindrical section 32 for securing the bolster 26 to the base portion 28. However, it will be appreciated that the rearward end 36 may be provided in various shapes and configurations or may not be necessary at all, i.e. the generally cylindrical section 32 could be directly attached or affixed to the base portion 28.

As shown in FIG. 2, the base portion 28 defines a pocket 56 configured for cooperating with and receiving the axial rearward end 36 of the bolster portion 26 for affixing or securing the bolster portion 26 to the base portion 28. In one example, the pocket 56 can include a first segment 58, second segment 60 axially rearward of the first segment 58 and a bottom 62. It will be appreciated that other configurations and arrangements for the pocket 56 can be provided in accordance with aspects of the invention.

Referring again to FIGS. 2 and 3-3D, in one example the rearward end 36 of the bolster portion 26 includes a first portion 64, a second portion 66 axially rearward of the first portion 64 and a bottom portion 68. It will be appreciated that other configurations and arrangements for the rearward end 36 can be provided in accordance with aspects of the invention. In addition, it will be appreciated that the pocket 56 is configured and arranged for receiving and affixing the rearward end 36 thereto.

More particularly, in one aspect the rearward end 36 of the bolster portion 26 can be affixed or attached by brazing the first portion 64, the second portion 66 and/or the bottom portion 68 to the first segment 58, second segment 60 and/or the bottom 62, respectively, of the pocket 56. In order to enhance the described brazing a plurality of projections 70 are provided and formed on the first portion 64 of the rearward end 36 (see, for example, FIGS. 3, 3B and 3D). In addition, to further enhance the brazing, a plurality of ribs 72 are provided and formed on the second portion 66 of the rearward end 36 (see, for example, FIGS. 3, 3B and 3C). Generally, the projections 70 and/or ribs 72 are configured for cooperating with the pocket 56 of the base portion 28 for affixing the bolster portion 26 to the cutting tool body 12. More particularly, the projections 70 and/or ribs 72 provide raised surfaces that extend generally outwardly from the rearward end 36 such that the first segment 58 and second segment 60 contact the projections 70 and ribs 72, respectively, providing spacing or a gap therebetween so as to allow the brazing to flow more easily and uniformly between the rearward end 36 and the pocket 56 and surfaces thereof. In addition, the projections 70 and/or ribs 72 can provide for accurate positioning, e.g. centering, of the rearward end 36 in the pocket 56.

In one aspect, the plurality of projections 70 and/or plurality of ribs 72 can be symmetrically positioned about a circumference of the rearward end 36 of the bolster portion 26 (see, for example, FIG. 3B). It will be appreciated that other configurations and arrangements of the projections 70 and/or ribs 72 can be provided in accordance with aspects of the invention.

Figure 4A:
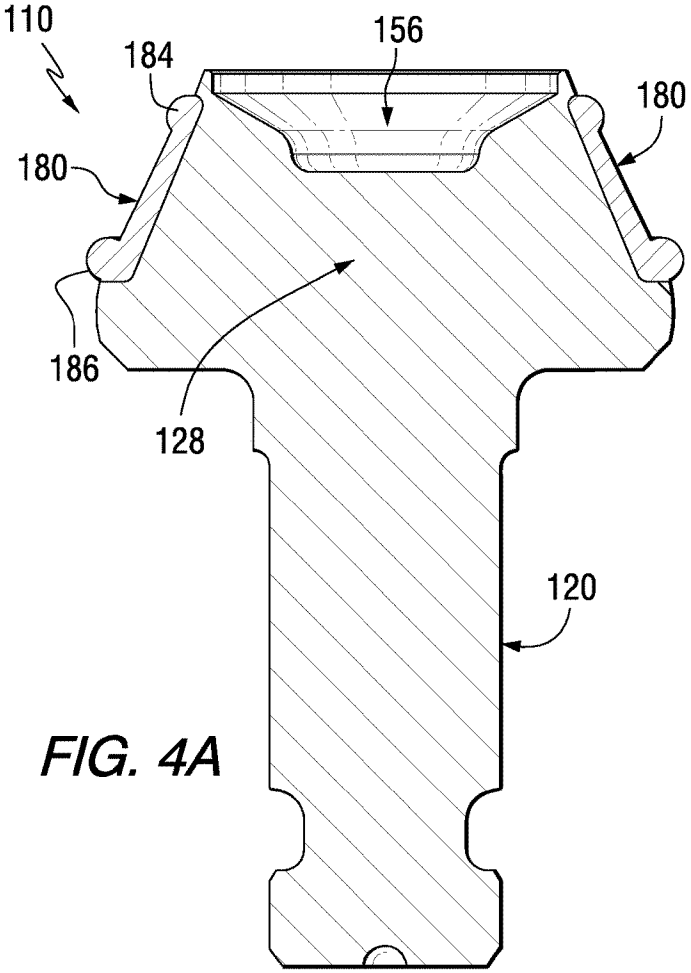
FIG. 4A is a sectional view along line 4A-4A of FIG. 4, in accordance with an aspect of the invention.
Figure 4:
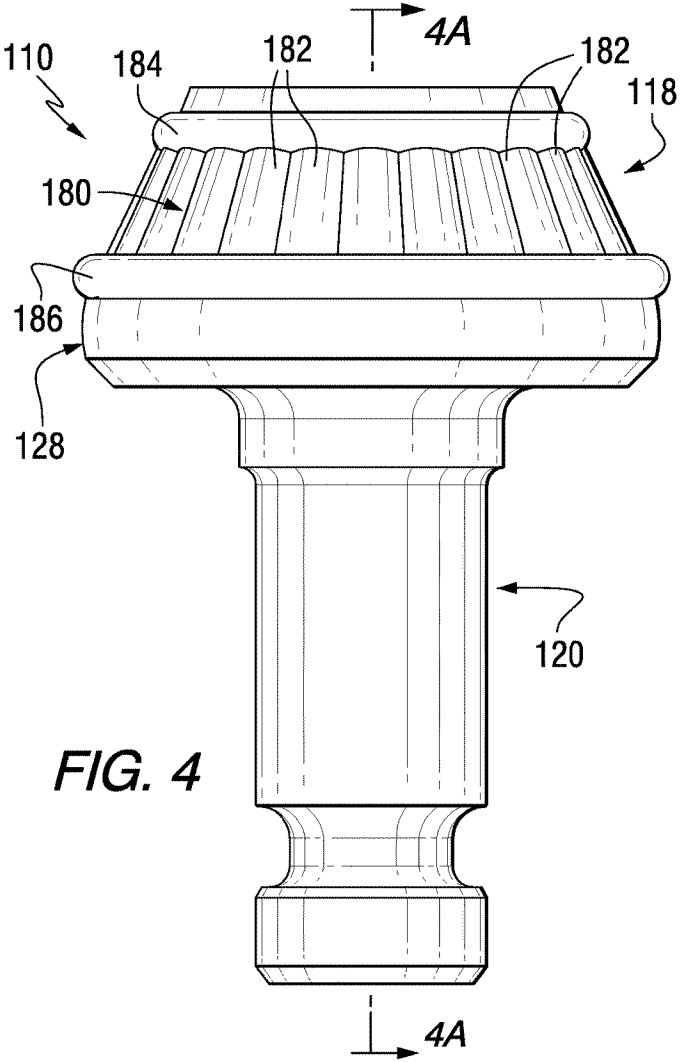
FIG. 4 is a side view of a portion of an additional cutting tool, in accordance with an aspect of the invention.
Figure 5A:
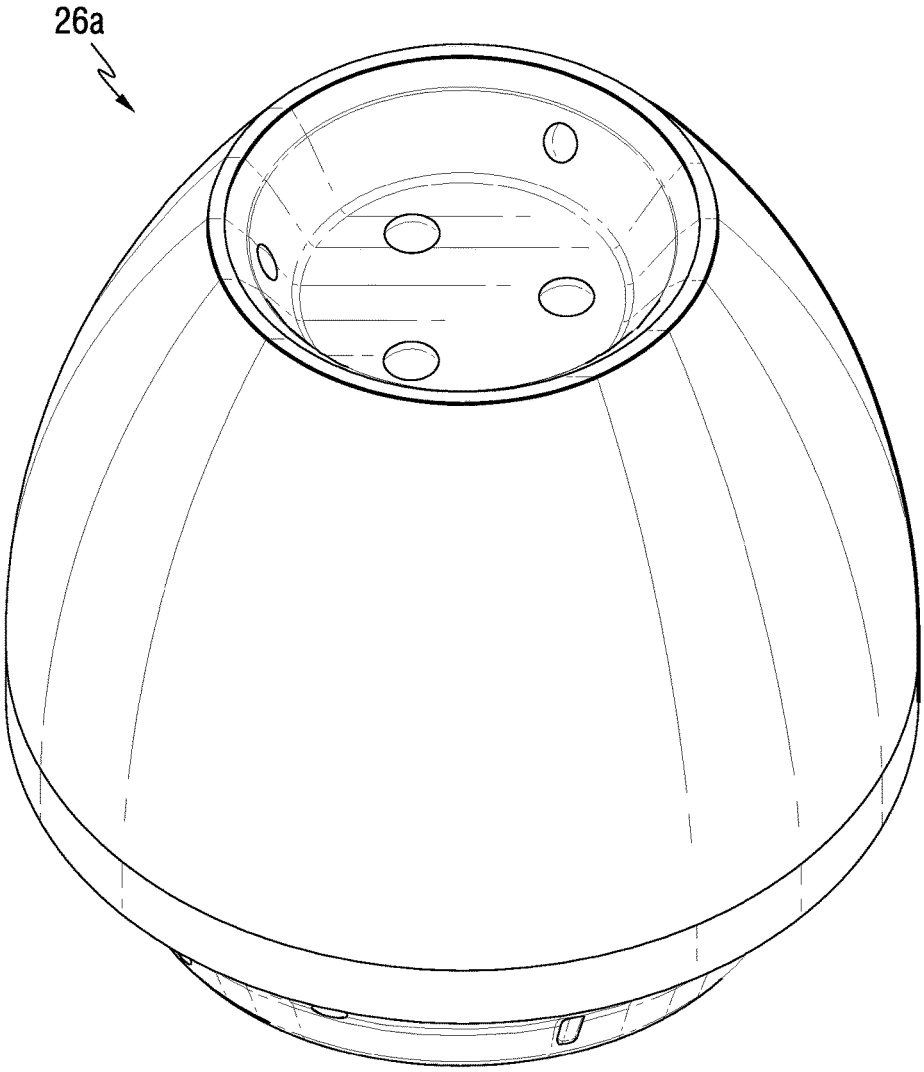
FIG. 5A is an isometric view of the bolster shown, for example, in FIG. 3AA, in accordance with an aspect of the invention.
Figure 5B:
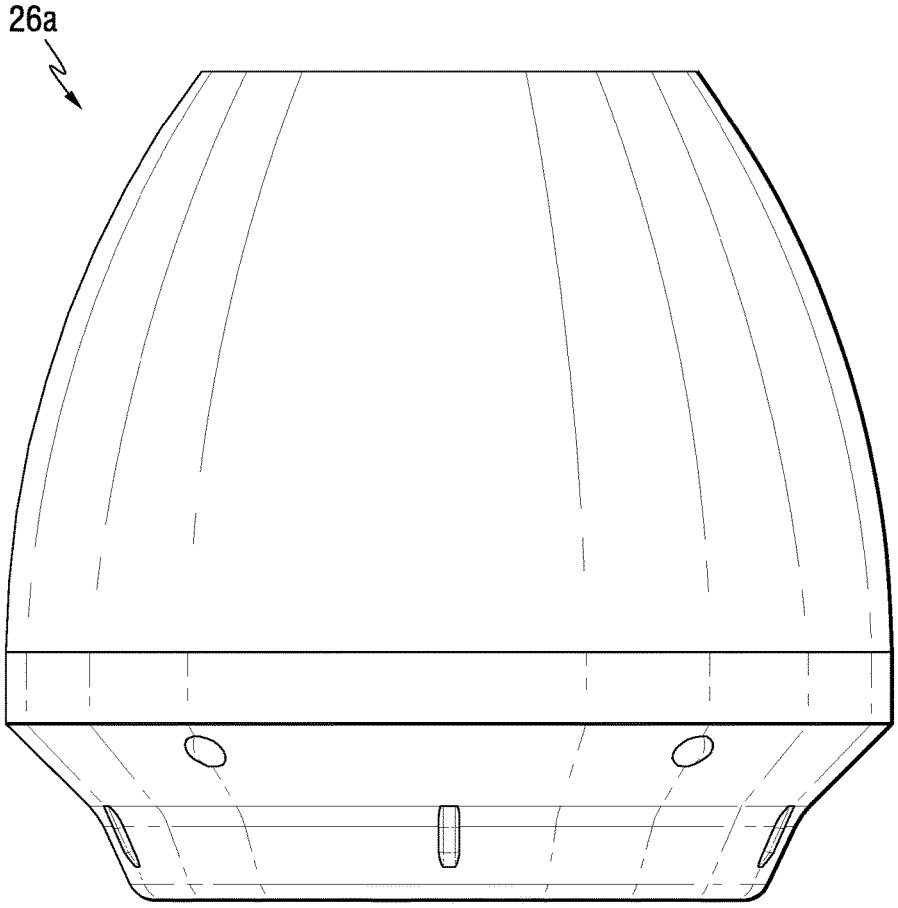
FIG. 5B is a front view of the bolster of FIG. 5A, in accordance with an aspect of the invention.
Figure 5C:
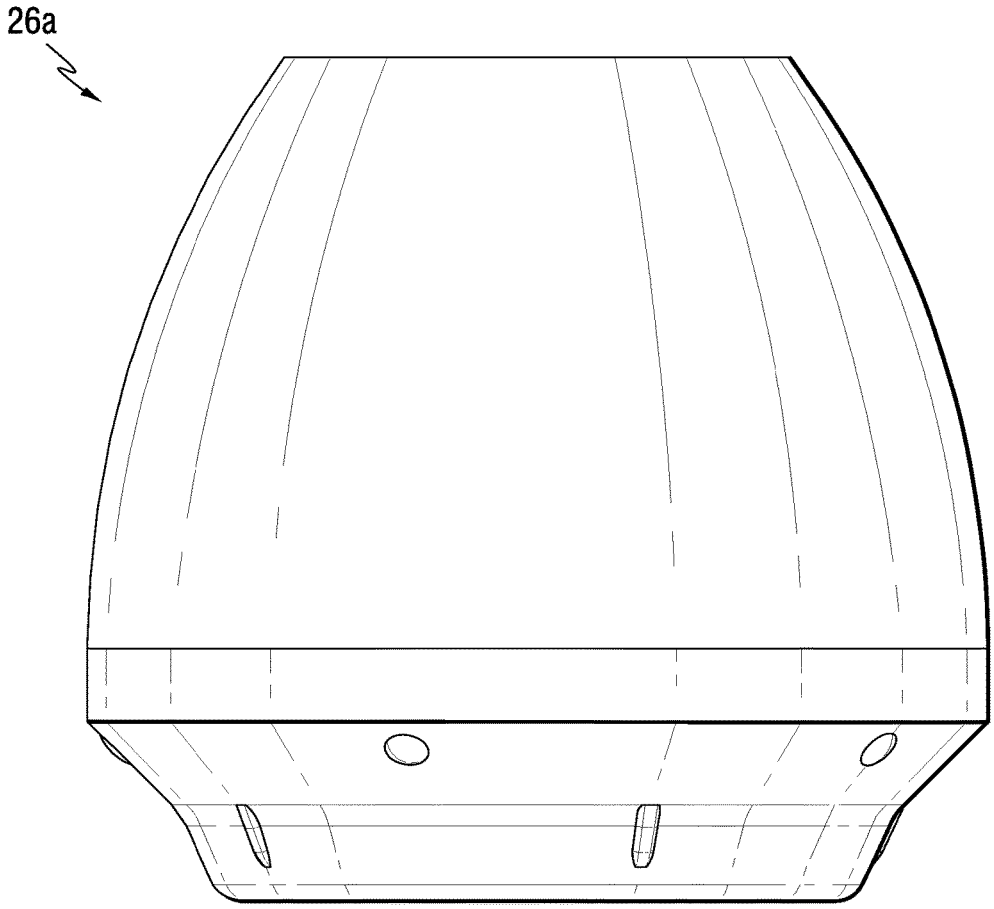
FIG. 5C is a left side view of the bolster of FIG. 5A, in accordance with an aspect of the invention.
Figure 5D:
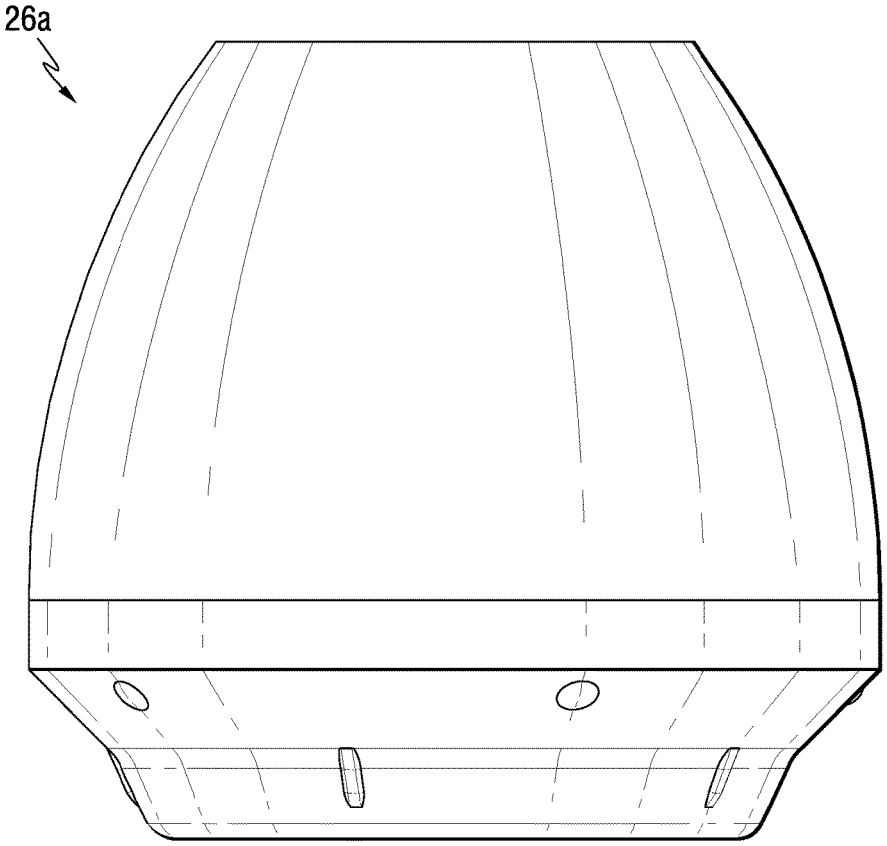
FIG. 5D is a right side view of the bolster of FIG. 5A, in accordance with an aspect of the invention.
Figure 5E:
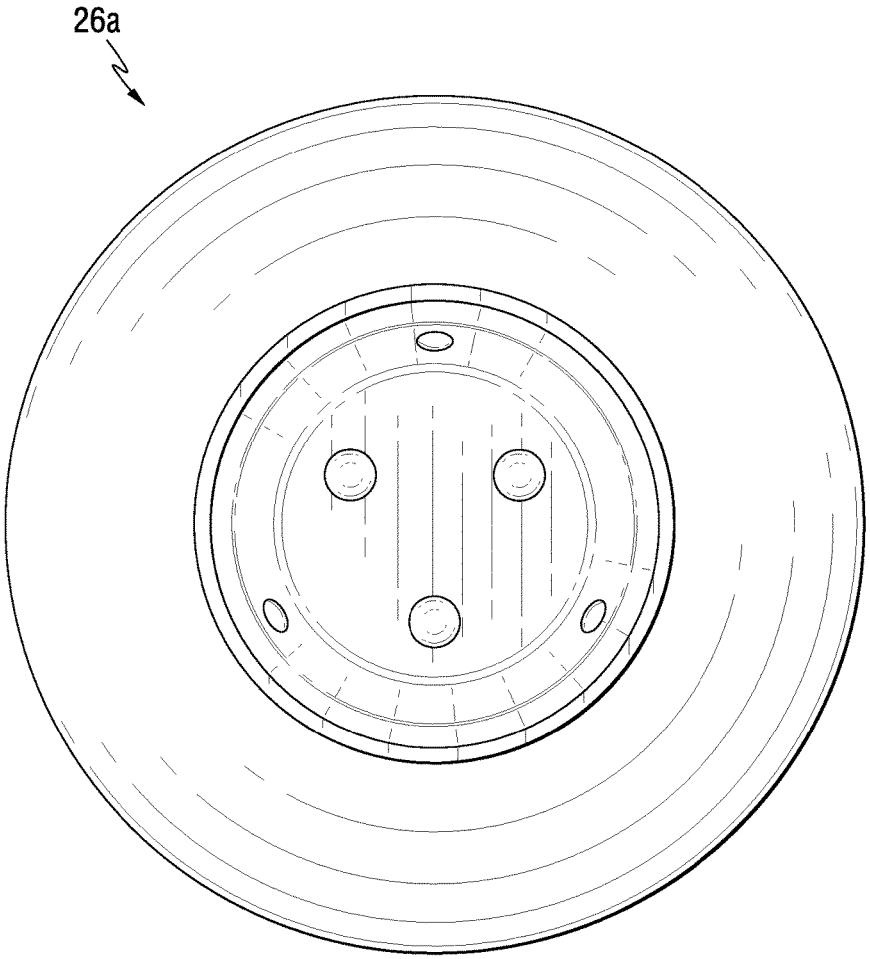
FIG. 5E is a top view of the bolster of FIG. 5A, in accordance with an aspect of the invention.
Figure 5F:
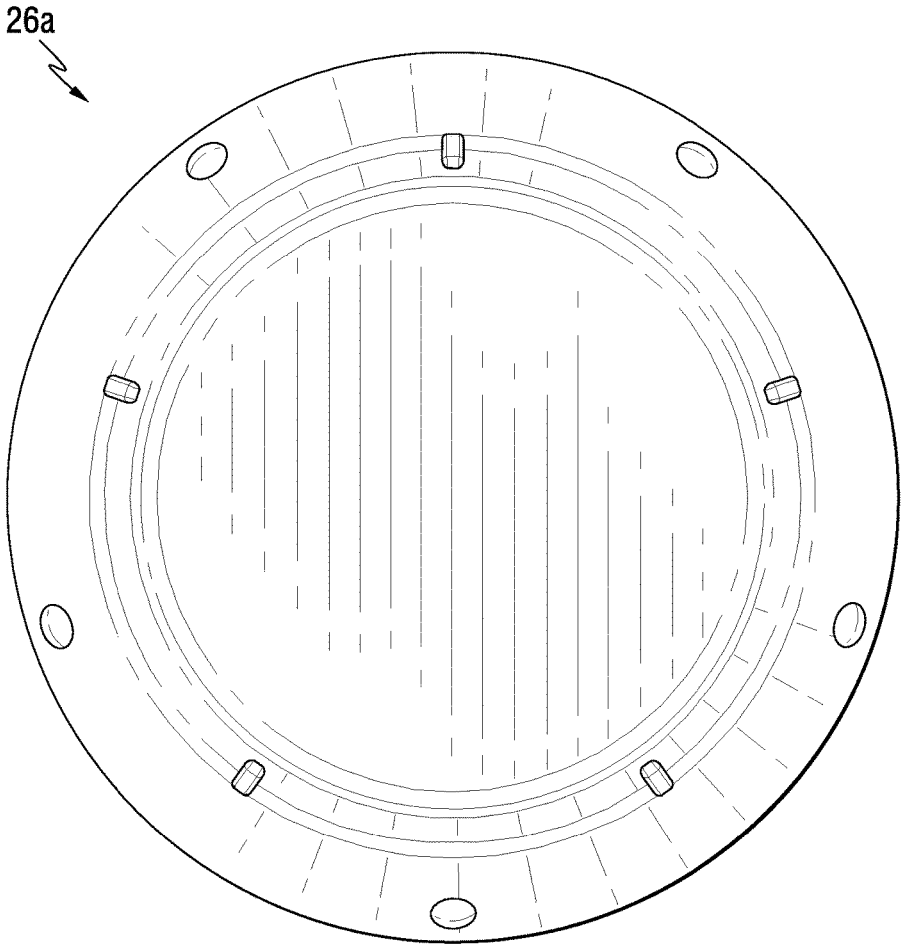
FIG. 5F is a bottom view of the bolster of FIG. 5A, in accordance with an aspect of the invention.
Figure 5G:
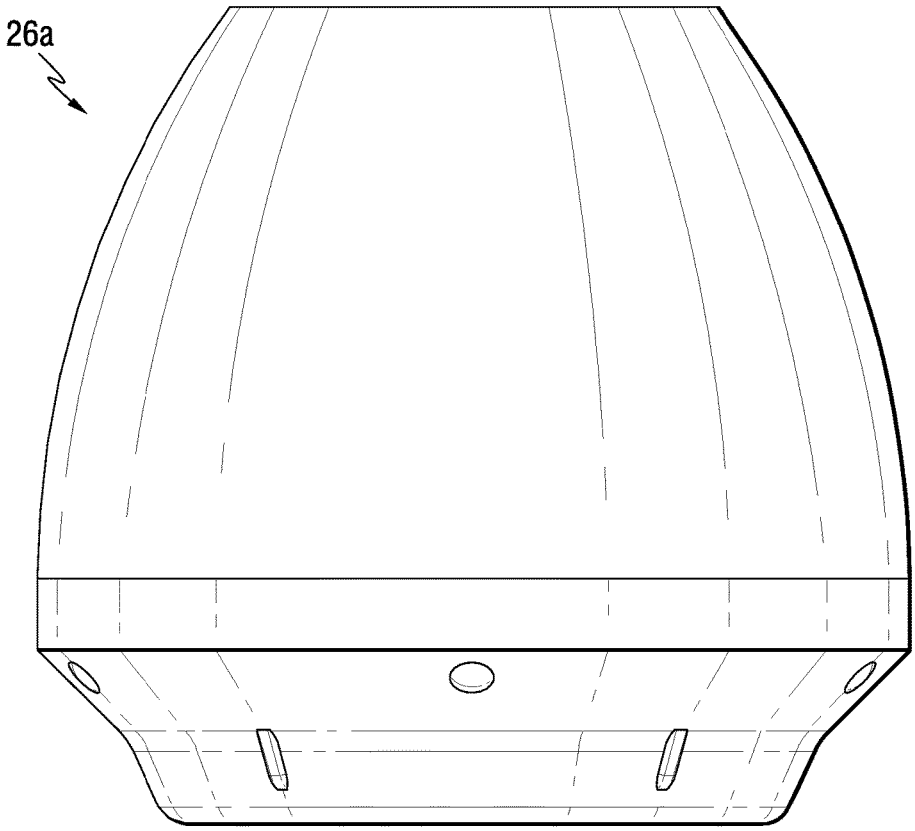
FIG. 5G is a rear view of the bolster of FIG. 5A, in accordance with an aspect of the invention.
Figure 6A:
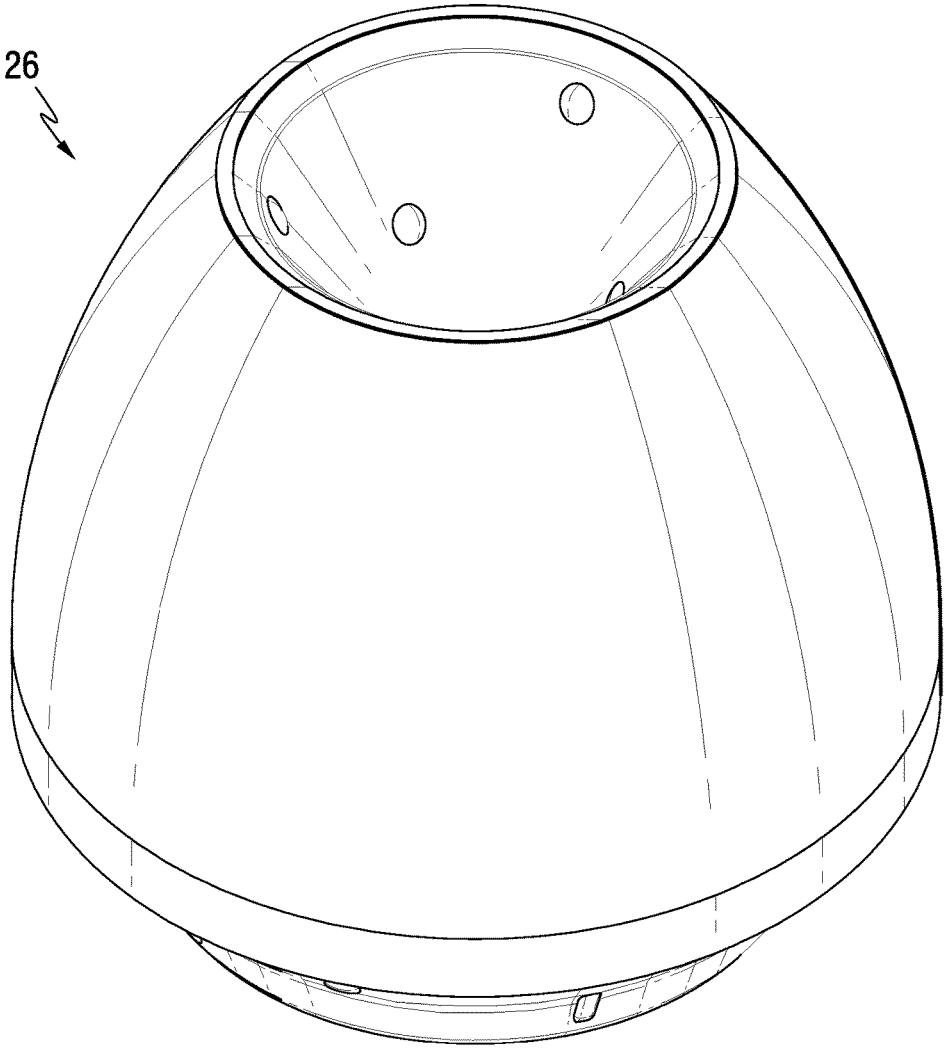
FIG. 6A is an isometric view of the bolster shown, for example, in FIG. 3, in accordance with an aspect of the invention.
Figure 6B:
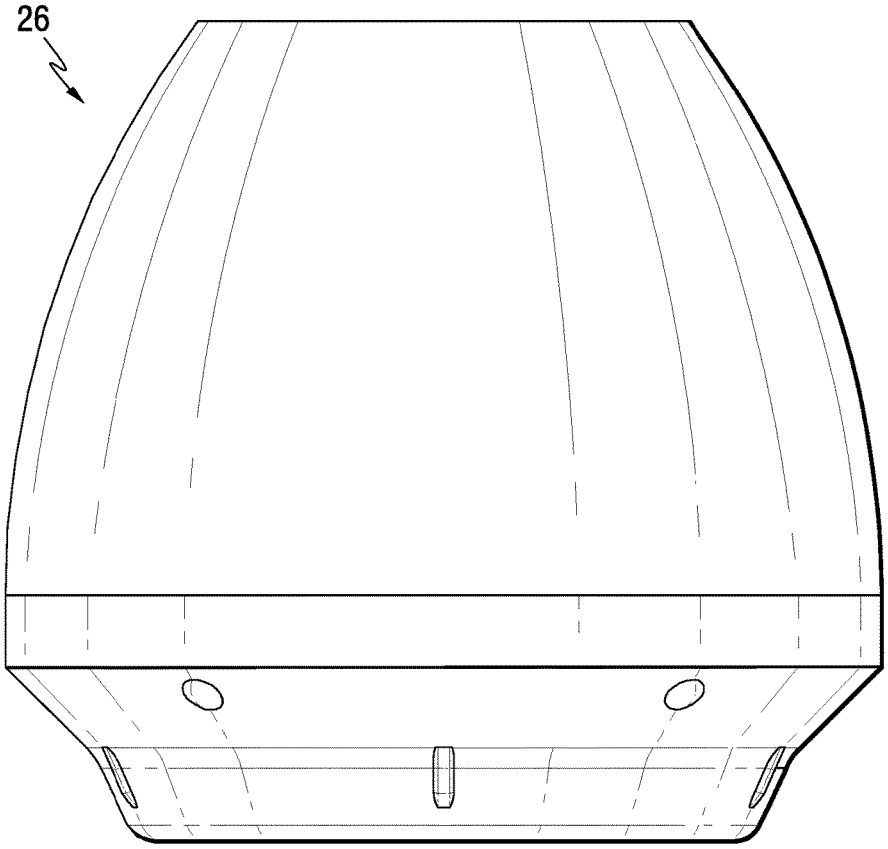
FIG. 6B is a front view of the bolster of FIG. 6A, in accordance with an aspect of the invention.
Figure 6C:
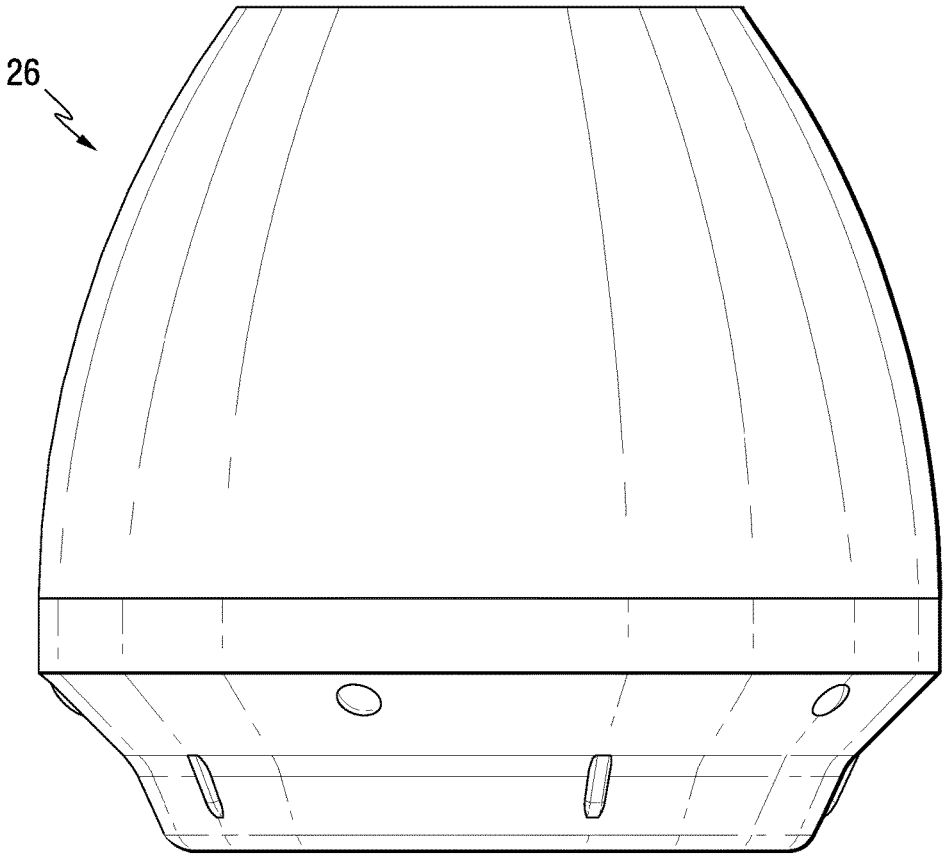
FIG. 6C is a left side view of the bolster of FIG. 6A, in accordance with an aspect of the invention.
Figure 6D:
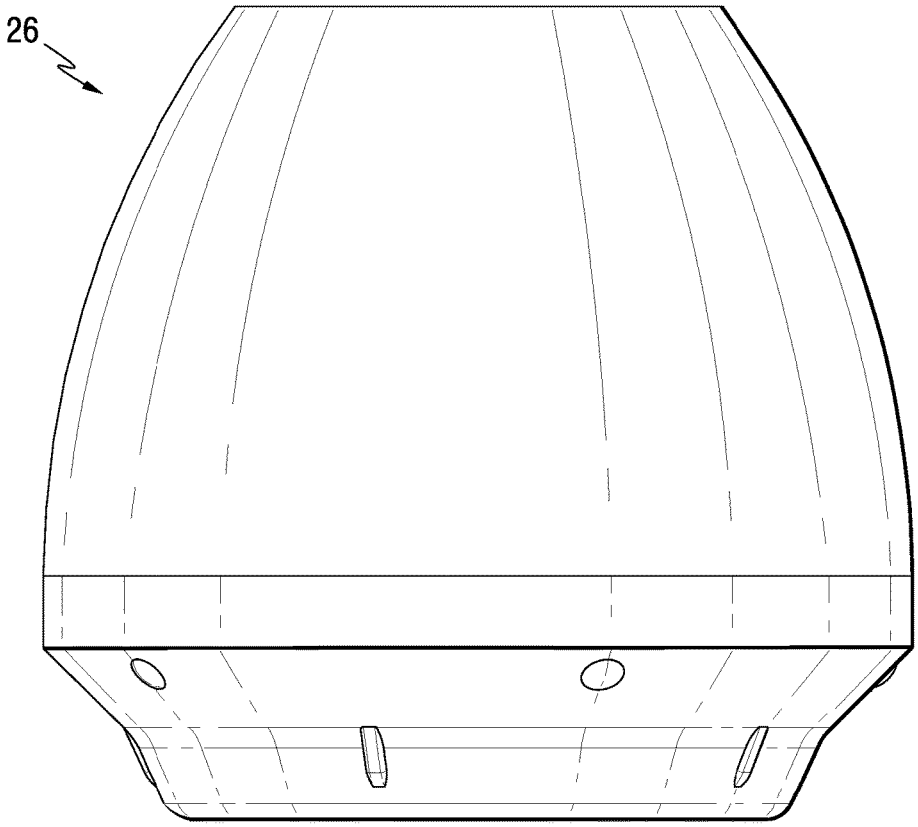
FIG. 6D is a right side view of the bolster of FIG. 6A, in accordance with an aspect of the invention.
Figure 6E:
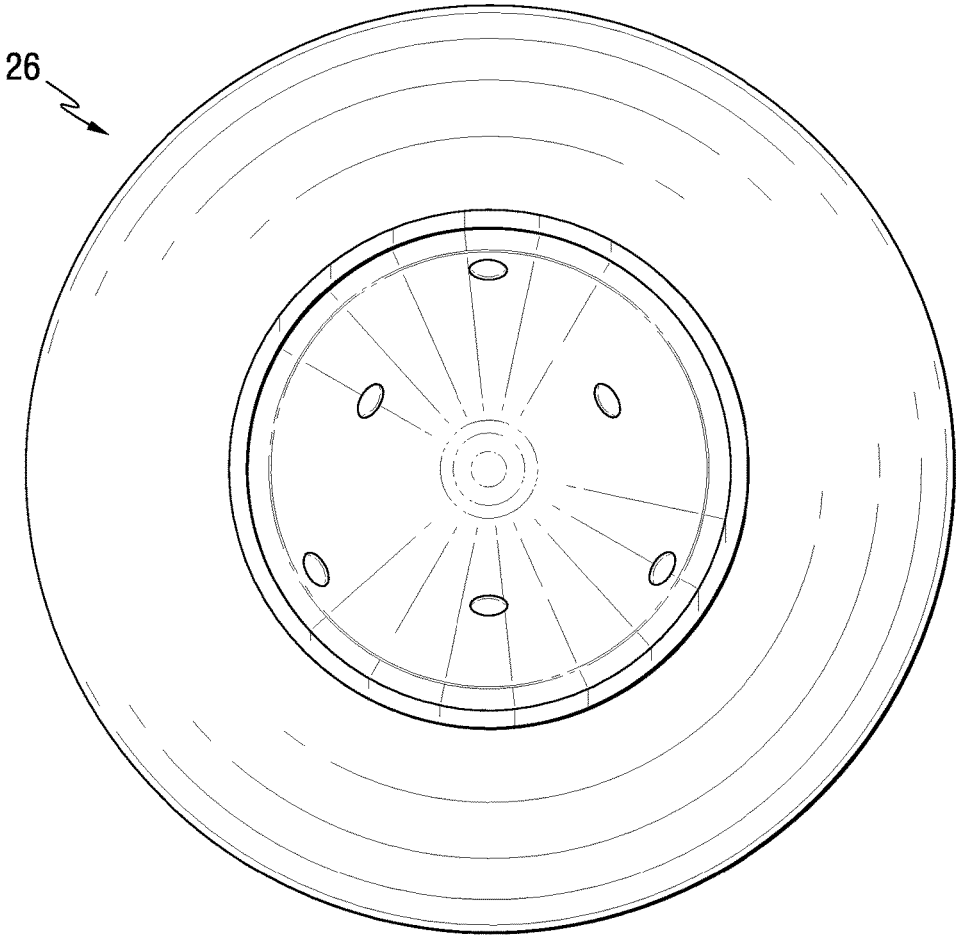
FIG. 6E is a top view of the bolster of FIG. 6A, in accordance with an aspect of the invention.
Figure 6F:
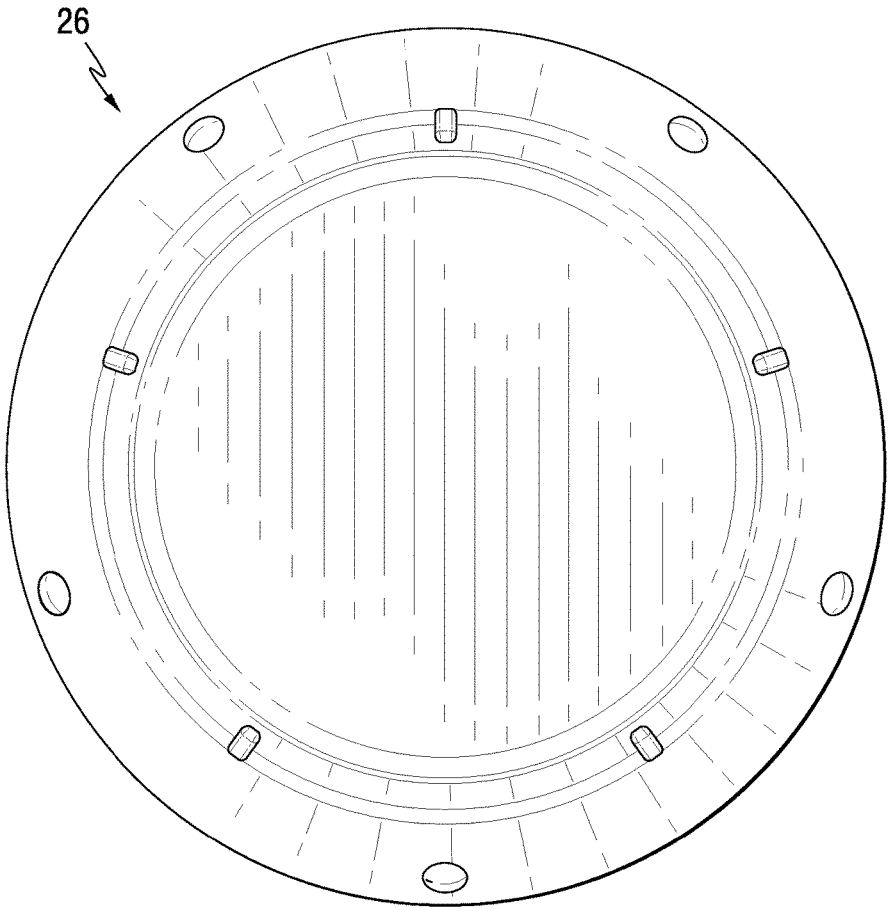
FIG. 6F is a bottom view of the bolster of FIG. 6A, in accordance with an aspect of the invention.
Figure 6G:
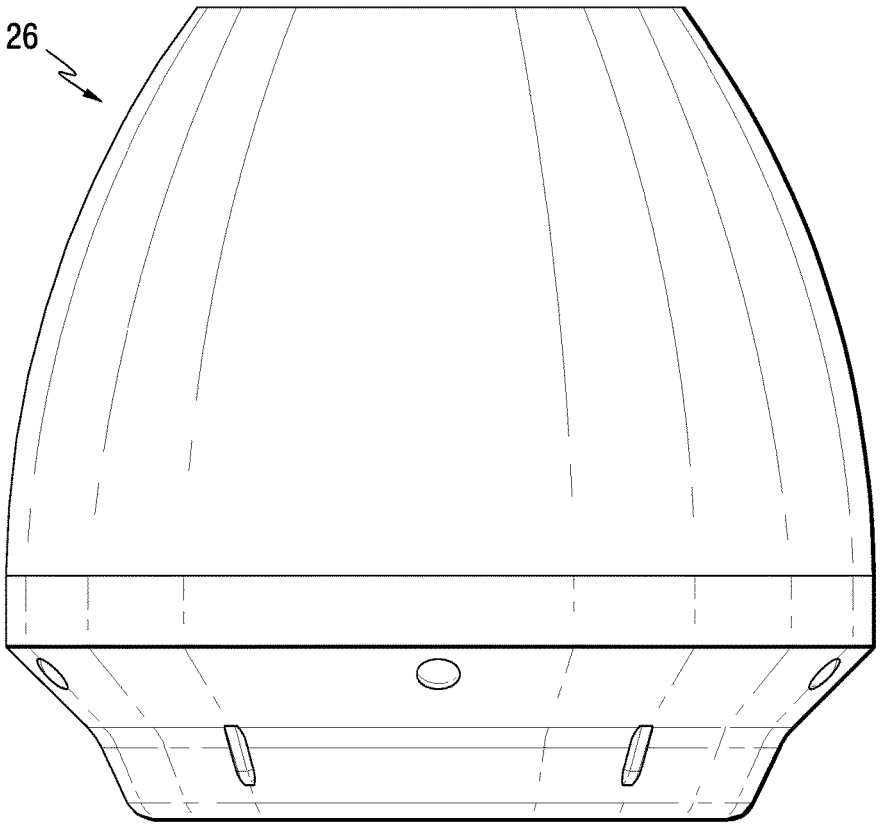
FIG. 6G is a rear view of the bolster of FIG. 6A, in accordance with an aspect of the invention.
Figure 7A:
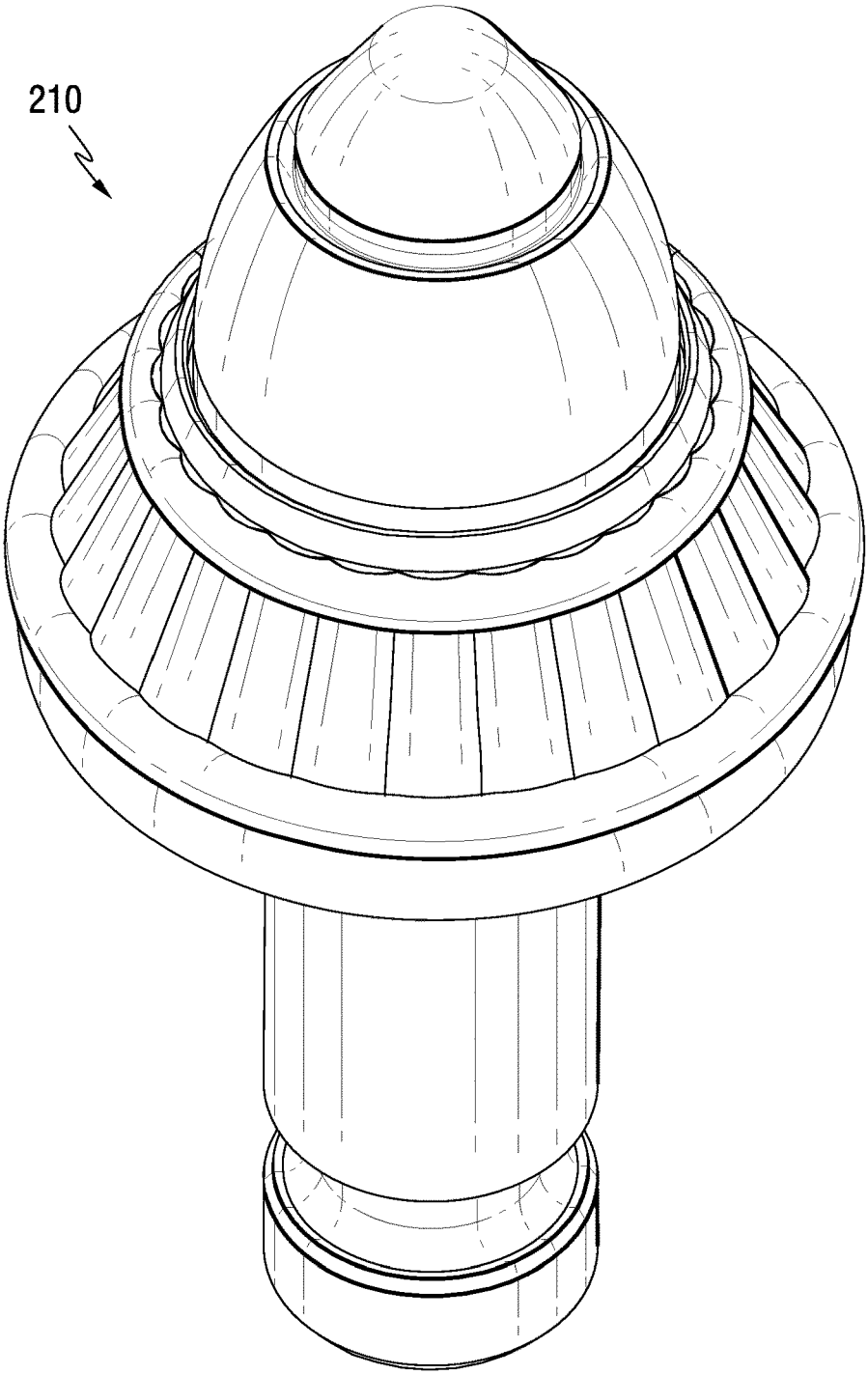
FIG. 7A is an isometric view of an additional cutting tool, in accordance with an aspect of the invention.
Figure 7B:
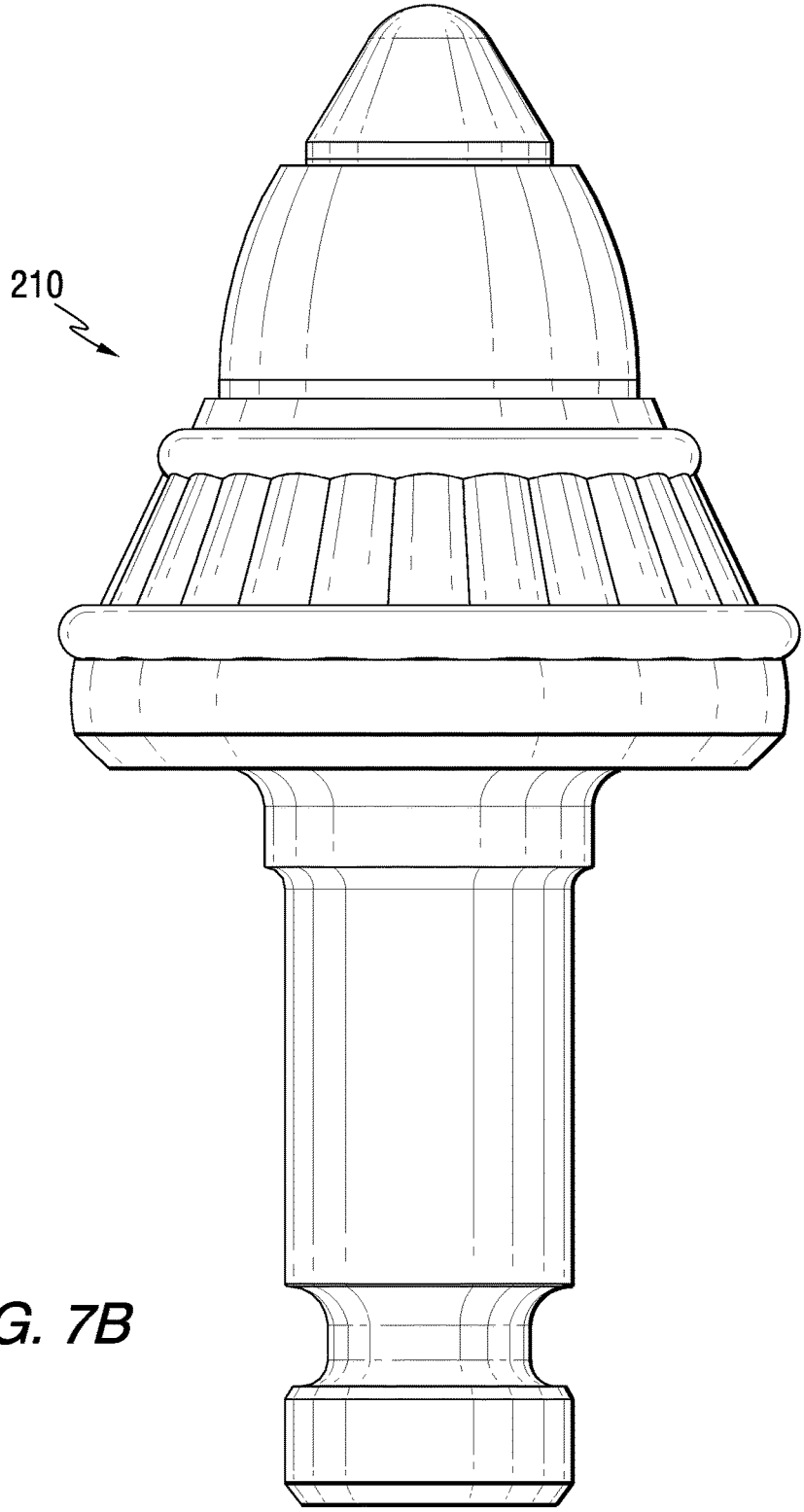
FIG. 7B is a front view of the cutting tool of FIG. 7A, in accordance with an aspect of the invention.
Figure 7C:
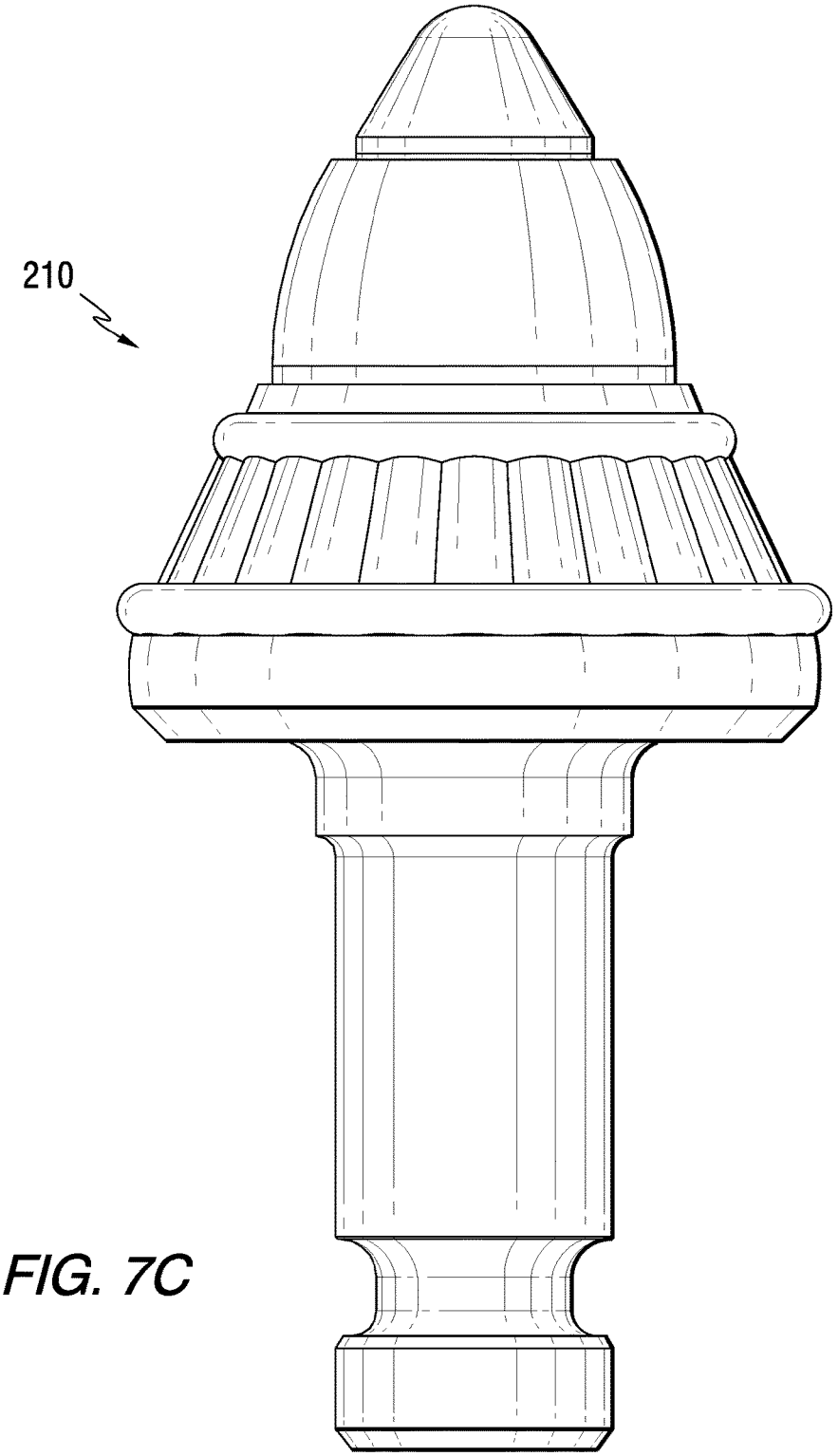
FIG. 7C is a left side view of the cutting tool of FIG. 7A, in accordance with an aspect of the invention.
Figure 7D:
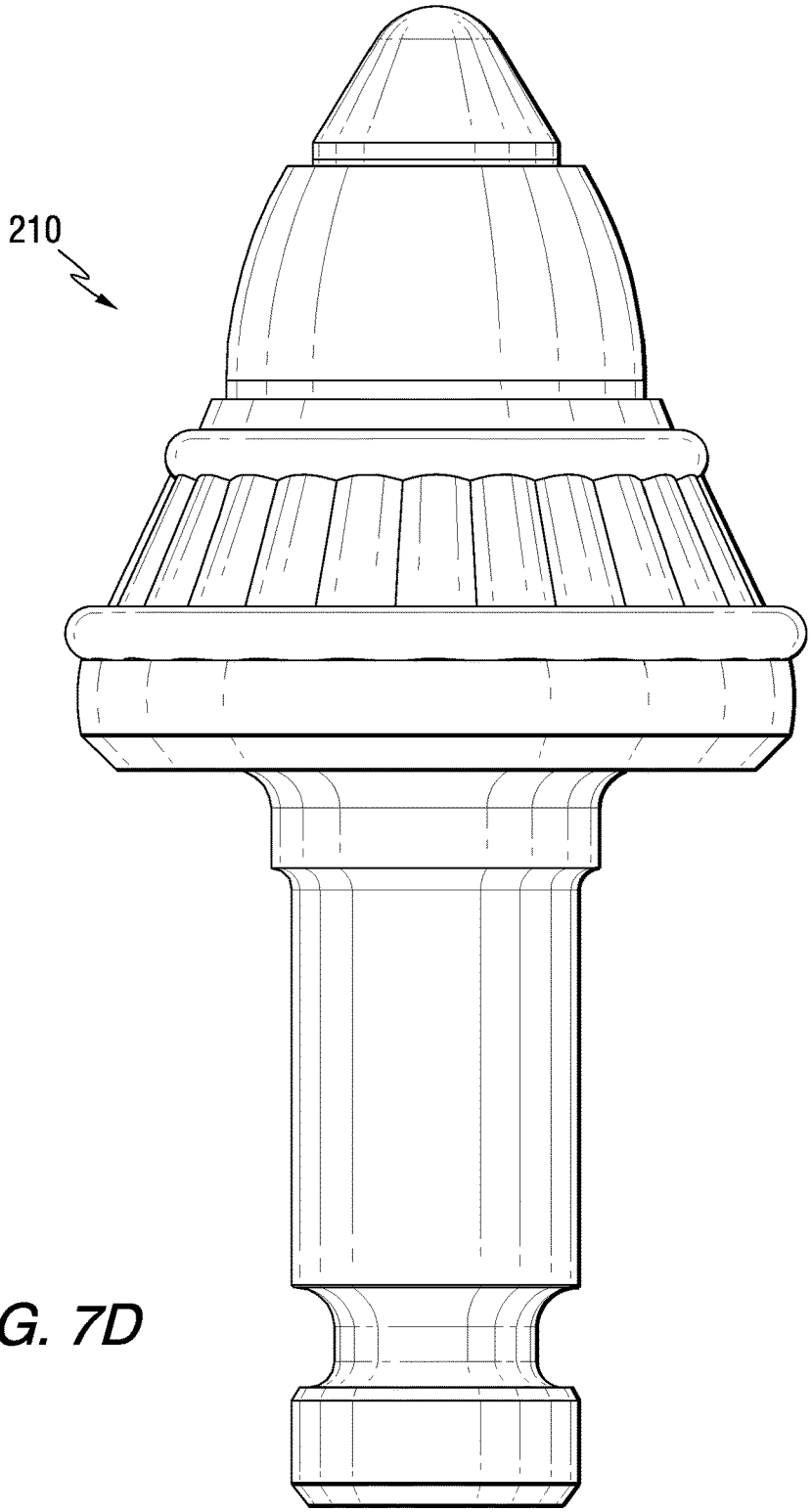
FIG. 7D is a right side view of the cutting tool of FIG. 7A, in accordance with an aspect of the invention.
Figure 7E:
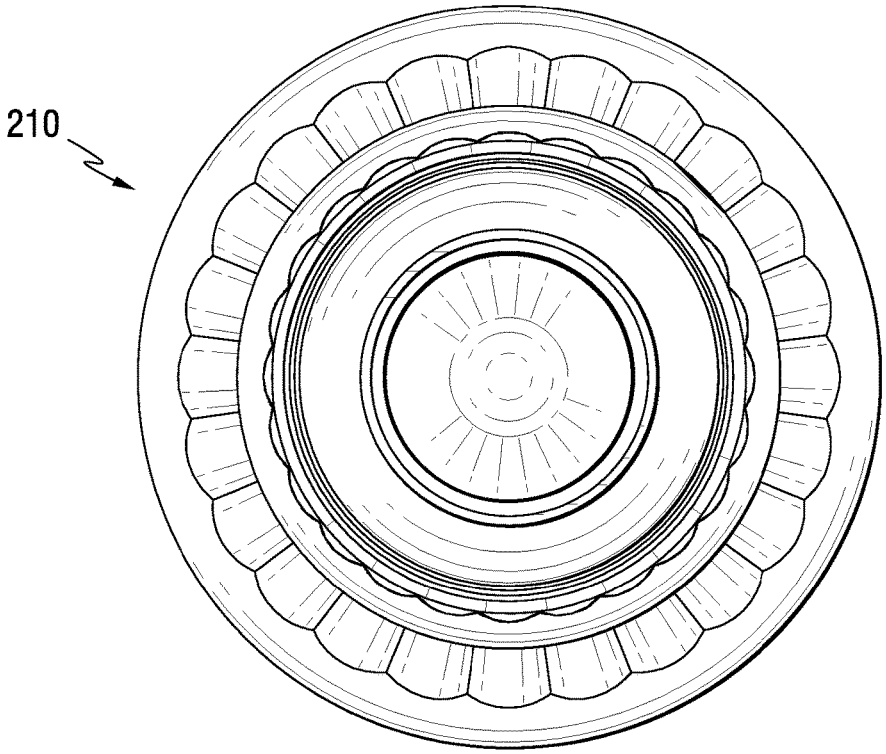
FIG. 7E is a top view of the cutting tool of FIG. 7A, in accordance with an aspect of the invention.
Figure 7F:
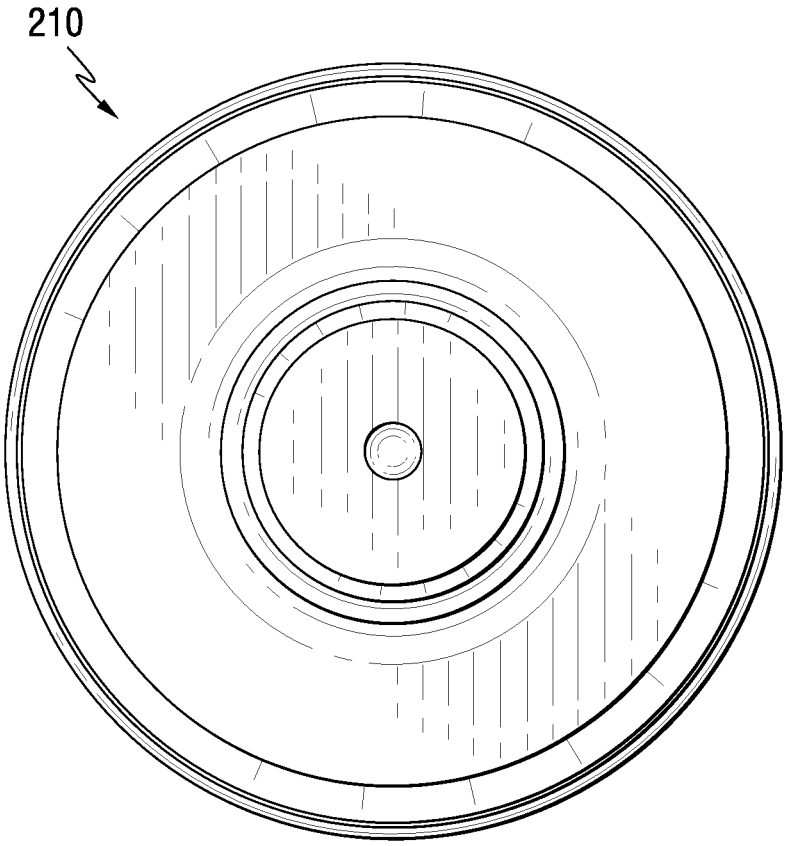
FIG. 7F is a bottom view of the cutting tool of FIG. 7A, in accordance with an aspect of the invention.
Figure 7G:
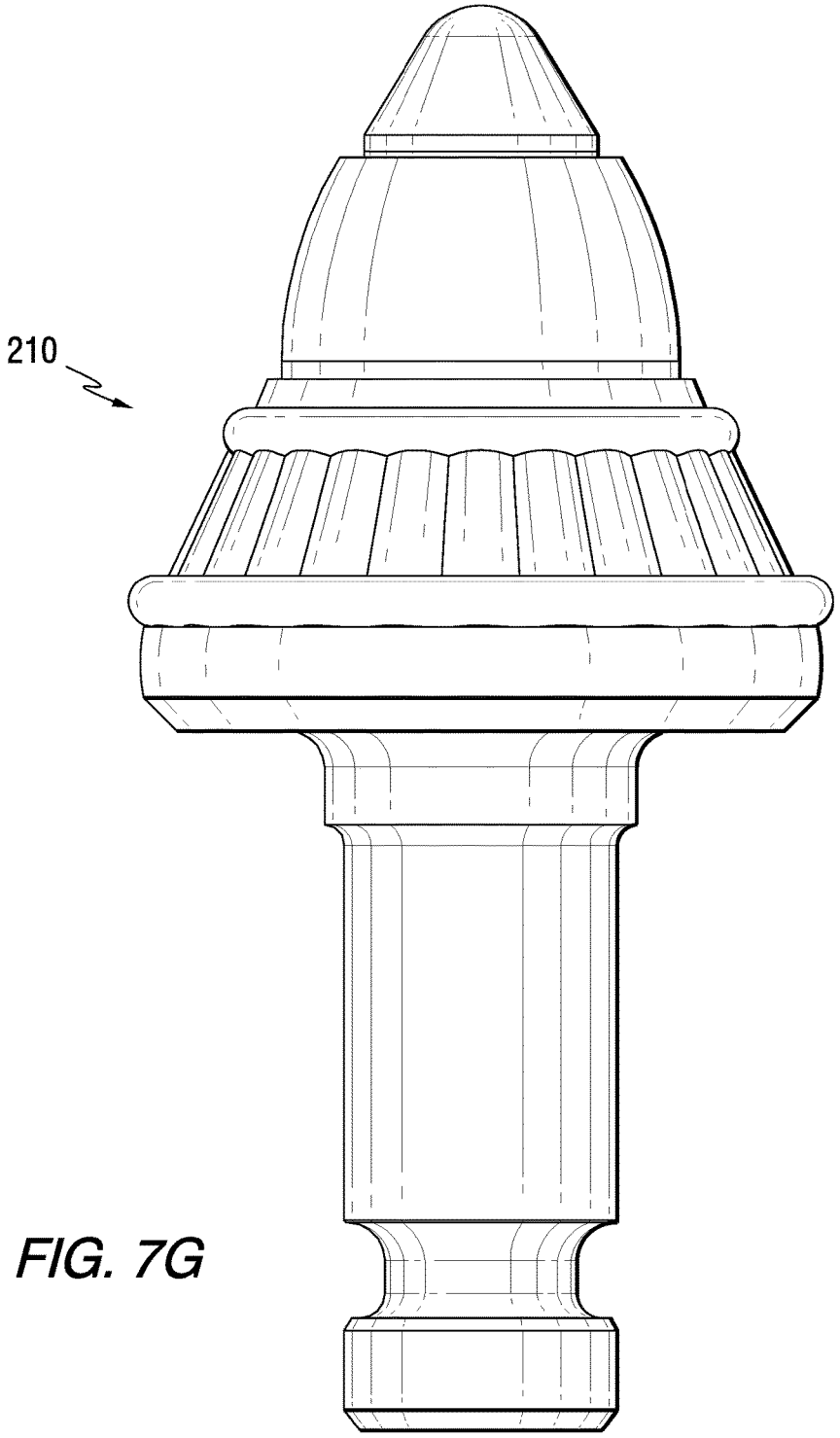
FIG. 7G is a rear view of the cutting tool of FIG. 7A, in accordance with an aspect of the invention.

Referring to FIGS. 4 and 4A, there is illustrated a portion of an additional cutting tool 110, in accordance with aspects of the invention. More particularly, there is shown a shank 120 and a base portion 128 of a head 118 having a pocket 156 for receiving a bolster and cutting member, similar to as described herein, but which are not shown for simplicity. In accordance with an important aspect of the invention, at least a portion of the base 128 may include a hardfacing treatment to, for example, improve overall strength and wear. More specifically, at least a portion of the base portion 128 of the head 118 includes a layer of a hardfacing material 180 deposited thereon. In the example shown in FIGS. 4 and 4A, the layer of hardfacing material 180 includes a series of vertical oscillation layers 182 formed or deposited circumferentially around the base portion 128 and configured between an axially forward circular or toroidal layer 184 of the hardfacing material and an axially rearward circular or toroidal layer 186 of the hardfacing material.

The layer of hardfacing material 180 may be applied using techniques such as, but not limited to, a plasma transferred arc (PTA) process, shielded metal arc welding (SMAW), gas metal arc welding (GMAW), oxyfuel welding (OFW), thermal spraying or laser cladding.

FIGS. 5A-5G further illustrate aspects of the bolster portion 26*a*. In addition, FIGS. 5A-5G set forth and illustrate the ornamental design of the bolster portion 26*a*, in accordance with aspects of the invention.

FIGS. 6A-6G further illustrate aspects of the bolster portion 26. In addition, FIGS. 6A-6G set forth and illustrate the ornamental design of the bolster portion 26, in accordance with aspects of the invention.

FIGS. 7A-7G further illustrate a cutting tool 210, in accordance with the invention. In one aspect, cutting tool 210 incorporates aspects of the cutting tool 110 as described and illustrated herein. In addition, FIGS. 7A-7G set forth and illustrate the ornamental design of the cutting tool 210, in accordance with aspects of the invention.

Whereas particular aspects of this invention have been described above for purposes of illustration, it will be evident to those skilled in the art that numerous variations of the details of the present invention may be made without departing from the invention as defined in the appended claims.

What is claimed is:

1. A cutting tool rotatable about a central longitudinal axis of the cutting tool and configured for impingement upon a substrate, the cutting tool comprising:

an elongate cutting tool body having a head and a shank axially rearward of the head, wherein the head and the shank are rotatable about the central longitudinal axis;

the shank including an annular groove for receiving a retainer ring to permit rotation of the shank about the central longitudinal axis;

wherein the head includes a cutting member at an axial forward end thereof, a bolster portion axially rearward of the cutting member and a base portion at an axial rearward end of the head;

wherein the bolster portion includes:

a convex shape section which includes a socket at an axial forward end thereof, the cutting member being affixed to the cutting tool body within the socket; and a generally cylindrical section contiguous with and axially rearward of the convex shape section; and wherein the head has an axial length dimension H, the convex shape section has an axial length dimension X and the generally cylindrical section has an axial length dimension Y, the ratio (X+Y)/H being in the range of 0.5 to about 0.75.

2. The cutting tool of claim 1, wherein the axial length dimension X is in the range of about 0.5 inches to about 1.0 inches, the axial length dimension Y is in the range of about 0.05 inches to about 0.55 inches and the axial length dimension H is in the range of about 1.7 inches to about 1.8 inches.

3. The cutting tool of claim 1, wherein the convex shape section of the bolster portion has a radius R in the range of about 1.2 inches to about 1.4 inches.

4. The cutting tool of claim 1, wherein the ratio Y/X is in the range of about 0.05 to about 1.0.

5. The cutting tool of claim 1, wherein at least a portion of the base portion of the head includes a layer of a hardfacing material deposited thereon.

6. The cutting tool of claim 1, wherein the cutting member includes a substrate and a layer of a superhard material adhered to the substrate.

7. The cutting tool of claim 6, wherein the layer of superhard material includes polycrystalline diamond (PCD) or polycrystalline cubic boron nitride (PcBN).

8. The cutting tool of claim 6, wherein the substrate of the cutting member generally tapers in the axial rearward direction.

9. The cutting tool of claim 8, wherein the socket includes sidewalls configured for receiving the tapered substrate of the cutting member.

10. The cutting tool of claim 1, wherein the substrate of the cutting member and the bolster portion of the head each include a cemented (cobalt) tungsten carbide material.

11. A cutting tool rotatable about a central longitudinal axis of the cutting tool and configured for impingement upon a substrate, the cutting tool comprising:

an elongate cutting tool body having a head and a shank axially rearward of the head, wherein the head includes:

a cutting member at an axial forward end thereof, the cutting member having a substrate and a layer of a superhard material adhered to the substrate;

a bolster portion axially rearward of the cutting member, wherein the bolster portion includes a convex shape section and a generally cylindrical section contiguous with and axially rearward of the convex shape section, the bolster further including a socket at an axial forward end thereof, wherein the socket includes a sidewall having a plurality of projections formed thereon and configured for cooperating with the substrate of the cutting member for affixing the cutting member to the cutting tool body;

wherein the projections:

each comprise a raised surface that extends outwardly from the sidewall; and provide spacing between the sidewall and the substrate of the cutting member; and a base portion at an axial rearward end of the head;

wherein the substrate of the cutting member and the sidewall of the socket both generally taper in the axial rearward direction; and wherein the substrate of the cutting member and the bolster portion of the head each include a cemented (cobalt) tungsten carbide material.

12. The cutting tool of claim 11, wherein the layer of superhard material of the cutting member includes polycrystalline diamond (PCD) or polycrystalline cubic boron nitride (PcBN).

13. The cutting tool of claim 12, wherein the tapered substrate of the cutting member is brazed to the tapered sidewall of the socket.

14. The cutting tool of claim 12, wherein the plurality of projections are symmetrically positioned within the socket about the central longitudinal axis of the cutting tool.

15. The cutting tool of claim 11, wherein the shank includes an annular groove for receiving a retainer ring to permit rotation of the shank about the central longitudinal axis.

16. A cutting tool rotatable about a central longitudinal axis of the cutting tool and configured for impingement upon a substrate, the cutting tool comprising:

an elongate cutting tool body having a head and a shank axially rearward of the head, wherein the head includes:

a cutting member at an axial forward end thereof, the cutting member having a substrate and a layer of a superhard material adhered to the substrate;

a bolster portion axially rearward of the cutting member, wherein the bolster portion includes a convex shape section and a generally cylindrical section contiguous with and axially rearward of the convex shape section, the bolster further including a socket at an axial forward end thereof, wherein the socket includes a sidewall having a plurality of projections formed thereon and configured for cooperating with the substrate of the cutting member for positioning the cutting member in the socket; and wherein the socket includes a sidewall having a plurality of projections formed thereon and configured for cooperating with the substrate of the cutting member for affixing the cutting member to the cutting tool body;

wherein the projections:

each comprise a raised surface that extends outwardly from the sidewall; and provide spacing between the sidewall and the substrate of the cutting member; and a base portion at an axial rearward end of the head;

wherein the head has an axial length dimension H, the convex shape section has an axial length dimension X and the generally cylindrical section has an axial length dimension Y, the ratio (X+Y)/H being in the range of about 0.5 to about 0.75;

wherein the substrate of the cutting member and the sidewall of the socket both generally taper in the axial rearward direction; and wherein the substrate of the cutting member and the bolster portion of the head each include a cemented (cobalt) tungsten carbide material.

17. The cutting tool of claim 16, wherein at least a portion of the base portion of the head includes a layer of a hardfacing material deposited thereon.

18. The cutting tool of claim 16, wherein the tapered substrate of the cutting member is brazed to the tapered sidewall of the socket.

* * * * *